US010156417B1

(12) United States Patent
Jolley et al.

(10) Patent No.: US 10,156,417 B1
(45) Date of Patent: Dec. 18, 2018

(54) COMPOSITE STRING MATERIAL

(71) Applicant: Hoyt Archery, Inc., Salt Lake City, UT (US)

(72) Inventors: Gideon S. Jolley, Syracuse, UT (US); Chris Webster, Stansbury Park, UT (US)

(73) Assignee: Hoyt Archery, Inc., Salt Lake City, UT (US)

( * ) Notice: Subject to any disclaimer, the term of this patent is extended or adjusted under 35 U.S.C. 154(b) by 0 days.

(21) Appl. No.: 15/648,230

(22) Filed: Jul. 12, 2017

(51) Int. Cl.
*F41B 5/14* (2006.01)
*F41B 5/00* (2006.01)

(52) U.S. Cl.
CPC ..... *F41B 5/1411* (2013.01); *F41B 5/0084* (2013.01)

(58) Field of Classification Search
CPC ..... F41B 5/14; F41B 5/1411
USPC ..... 124/90
See application file for complete search history.

(56) References Cited

U.S. PATENT DOCUMENTS 5,715,804 A * 2/1998 Izuta ..... F41B 5/14 124/90
5,884,617 A * 3/1999 Nelson ..... F41B 5/14 124/90
6,253,754 B1 * 7/2001 Ward ..... F41B 5/14 124/90
6,651,643 B2 * 11/2003 Simonds ..... F41B 5/14 124/90
6,712,060 B2 * 3/2004 Egusquiza ..... F41B 5/1415 124/91
7,182,079 B2 * 2/2007 McPherson ..... F41B 5/14 124/90
7,231,915 B2 * 6/2007 McPherson ..... F41B 5/14 124/90
8,826,896 B1 * 9/2014 McPherson ..... F41B 5/1426 124/90
9,612,076 B2 * 4/2017 Griggs ..... F41B 5/1411
2012/0152219 A1 * 6/2012 McPherson ..... F41B 5/1411 124/25
2014/0261366 A1 * 9/2014 McPherson ..... D02G 3/444 124/90

* cited by examiner

*Primary Examiner* — Alexander Niconovich
(74) *Attorney, Agent, or Firm* — Dorsey & Whitney LLP

(57) ABSTRACT

A composite string such as a bowstring or cable used in archery bows and crossbows includes multiple types of strands or multiple types of materials in its strands. The different materials or strands have different properties such as stiffness, strength, abrasion resistance, or density. The string therefore has specialized properties such as different properties when subjected to different tensile loads or optimized durability. A serving material is also used to bind strands of material to the string for silencing, vibration dampening, improving durability, or providing additional rigidity to select portions of the string.

32 Claims, 17 Drawing Sheets

COMPOSITE STRING MATERIAL

TECHNICAL FIELD

The present disclosure generally relates to strings and cables for archery equipment and apparatus, materials, and methods used in their construction and implementation.

BACKGROUND

Bows and crossbows use at least one bowstring or cable to hold tension in their limbs and to shoot arrows and bolts. A traditional bow, recurve bow, or crossbow may have a single bowstring connecting the limbs. Compound bows and crossbows typically have a long bowstring that wraps around the end cams and is used to shoot the arrow, a control buss cable (CBC) connecting the bottom cam to the top cam (or vice versa), and a yoked buss cable (YBC) connecting the top axle to the bottom cam (or vice versa).

Materials used for strings in bows have evolved over time from sinew and horsehair to steel cabling, to current thermoplastic fibers and other modern materials bundled together. With almost all of these materials, the string is formed when multiple fibers are twisted or otherwise connected to each other in multiple strands. Each strand typically has similar material construction and length. The strands are then twisted together and entwined into the length and shape needed for the strings. Some portions may also be served in high-wear areas with serving material that wraps circumferentially around the diameter of the entwined strands.

Constructing a bowstring in this manner provides a bowstring with strand material that has high elastic modulus, high tensile break strength, high efficiency (often due to the strand material having low density), and the ability to separate the bundle of fibers into two side-by-side halves in a manner allowing the archer to place a peep sight into the string. The entwined string is also relatively easy to make since the string generally consists of one continuous strand of material (or in some cases two strands having the same material but different color) which is wrapped multiple times in a loop configuration without having to be cut along its length.

However, even these advanced strings lack resistance to abrasion and wear (which is one reason that certain portions are served), lack resistance to localized heat (i.e., they may melt easily when exposed to flame), and lack resistance to unintended cutting, particularly when the string is under high tension. For these and other reasons, archers and other sportsmen are constantly seeking improvements to bowstrings and cables used in archery equipment.

SUMMARY

One aspect of the present disclosure relates to a composite archery string. The string may comprise a plurality of generally longitudinal strands which comprise at least a first strand and a second strand. The first strand may have a first length, and the second strand may have a second length, with the first length being different from the second length. Upon application of a first tensile load to the plurality of generally longitudinal strands, the first strand may bear a first proportion of first tensile load relative to the second strand, and upon application of a second tensile load to the plurality of generally longitudinal strands, the first strand may bear a second proportion of the second tensile load relative to the second strand, with the second proportion being less than the first proportion and with the second tensile load being greater than the first tensile load.

In some embodiments, the first strand may bear the entire first tensile load upon application of the first tensile load, and the first strand may bear less than the entire second tensile load upon application of the second tensile load. At least one of the first and second strands may be configured to extend upon application of the second tensile load at least until the first and second strands have equal lengths.

The first length of the first strand may comprise a bow-contacting portion and a bending portion, and the second length of the second strand may be positioned between the bow-contacting portion and the bending portion on the first strand. The first and second lengths may overlap on the string, and the first strand may be more rigid where the first length overlaps the second length of the second strand than along a remaining length of the first strand.

The first strand may comprise a first material, and the second strand may comprise a second material, with the first material being different than the second material. The first material may have a material property different from the second material, wherein the material property may be at least one of density, elasticity, bending resistance, abrasion resistance, tensile strength, and toughness.

The string may further comprise a helically winding material positioned around the plurality of generally longitudinal strands, wherein the second strand may extend through the helically winding material.

The second strand may be configured to extend through a portion of the string contacting a portion of a bow that is rotatable relative to a limb or cable guard of the bow. The second strand may in some cases extend through a portion of the string configured to be nocked with an arrow when the string is attached to a bow and the bow is drawn.

The string may also comprise at least one strand positioned radially spaced apart from the plurality of generally longitudinal strands, wherein tension in the at least one strand may be configured to be less than tension in the plurality of generally longitudinal strands.

In some arrangements, the string may further comprise a matrix material positioned external to the plurality of generally longitudinal strands. The first strand may comprise a first plurality of strands and the second strand may comprise a second plurality of strands, wherein the first plurality of strands may have a different radial position in the plurality of generally longitudinal strands relative to the second plurality of strands.

Another aspect of the disclosure relates to a composite archery string that comprises a plurality of entwined strands. The plurality of entwined strands may comprise a first portion of strands, a second portion of strands, and a generally longitudinal axis, with the first portion of strands and the second portion of strands each extending substantially parallel to the generally longitudinal axis. The first portion of strands may comprise a first length and a first material, and the second portion of strands may comprise a second length and a second material. The first length may be different from the second length, and the first material may be different from the second material.

The first portion of strands and the second portion of strands may each be configured to have a substantially equal length upon application of a tensile load to the plurality of entwined strands. The first material may differ from the second material due to material properties comprising at least one of bending resistance, toughness, abrasion resistance, density, and tensile elasticity. The composite archery string may comprise a first length portion and a second length portion, with the first length portion having greater resistance to bending than the second length portion.

The string may further comprise a serving material positioned radially external to the plurality of entwined strands, wherein the serving material may comprise a third material that is different from the first and second materials. Additional strands comprising the first or second material may be positioned on the plurality of entwined strands at positions configured to bear higher concentrations of stress relative to other positions on the string where the additional strands are not positioned. The second portion of strands may be spaced radially away from the first portion of strands.

In yet another aspect of the disclosure, an archery bow is disclosed that comprises a riser, an upper limb and a lower limb, with the upper and lower limbs being connected to the riser, an upper string contacting portion and a lower string contacting portion, with the upper string contacting portion being positioned on the upper limb and with the lower string contacting portion being positioned on the lower limb, and a string extending from the upper limb to the lower limb. The string may comprise a first portion contacting the upper string contacting portion, a second portion contacting the lower string contacting portion, and a third portion extending between the first portion and the second portion. The first portion may comprise a first density, the third portion may comprise a second density, and the first density may be greater than the second density.

The upper string contacting portion may comprise a groove, with the first portion contacting the upper string contacting portion within the groove. In some embodiments, the second portion may comprise the first density.

The first portion may also comprise a serving material extending along a length of the first portion, and the first portion may comprise at least one longitudinal strand extending along the length. The serving material may be denser than the at least one longitudinal strand. The string may be a bowstring or a buss cable. In some arrangements, the string comprises a fourth portion configured to engage a cable guard or string dampener of the bow, wherein the fourth portion may comprise a third density that is greater than the second density. The first and second portions may be more flexible than the third portion.

The first portion may comprise a first length, the third portion may comprise a second length, and a third length may extend across the first and second lengths. A first longitudinal strand may extend across the third length, and a second longitudinal strand may extend across only the first length or the second length. The first and second string contacting portions may be cams or limbs of the bow.

Yet another aspect of the disclosure relates to a composite archery string that comprises a plurality of generally longitudinal strands and a helically winding material positioned around the plurality of generally longitudinal strands. The plurality of generally longitudinal strands may have a first density, and the helically winding material may have a second density. The second density may be greater than the first density. The above summary of the present invention is not intended to describe each embodiment or every implementation of the present invention. The Figures and the detailed description that follow more particularly exemplify one or more preferred embodiments.

BRIEF DESCRIPTION OF THE DRAWINGS

The accompanying drawings and figures illustrate a number of exemplary embodiments and are part of the specification. Together with the present description, these drawings demonstrate and explain various principles of this disclosure. A further understanding of the nature and advantages of the present invention may be realized by reference to the following drawings. In the appended figures, similar components or features may have the same reference label.

Figure 1:
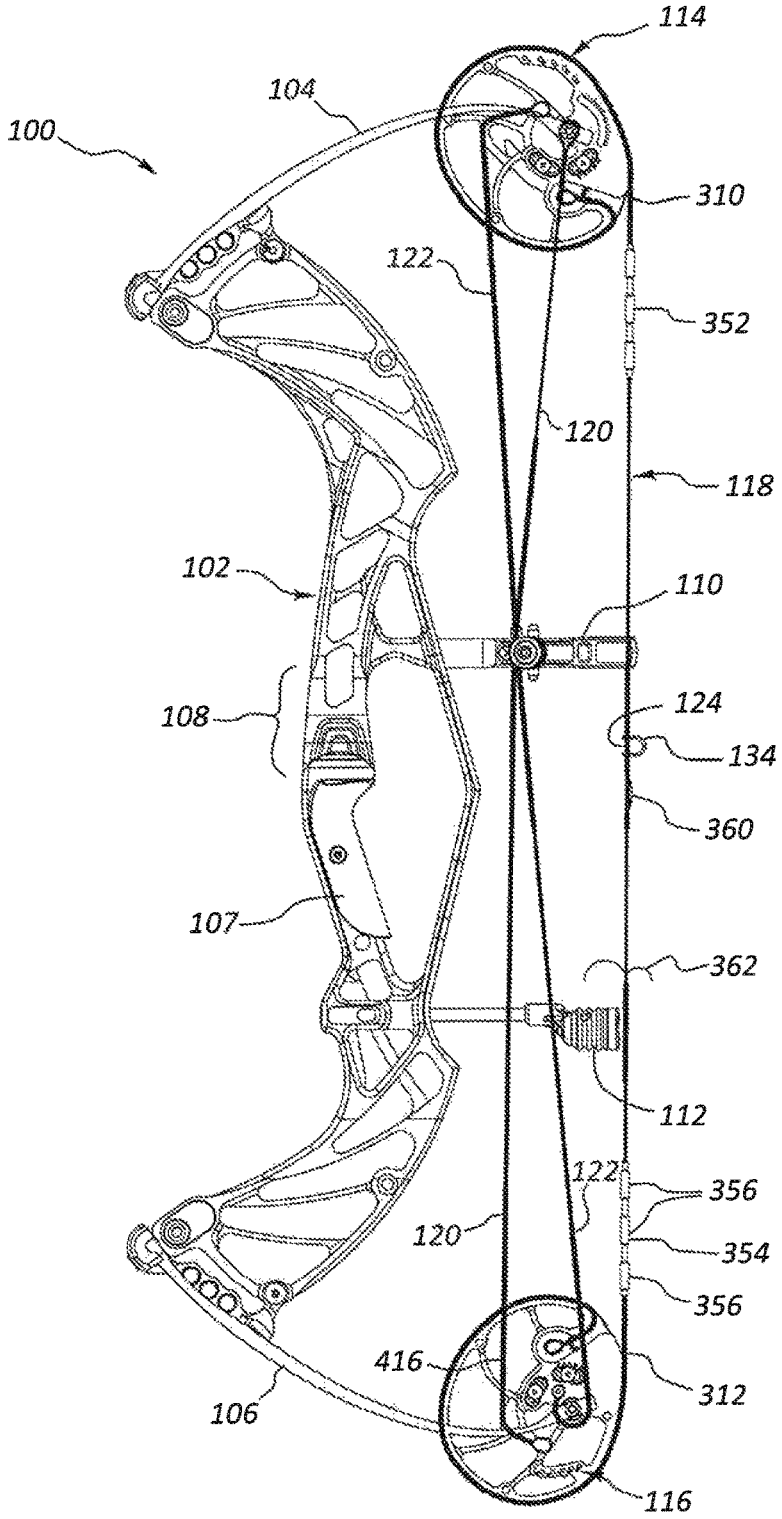
FIG. 1 is a side view of a bow in a brace condition according to an embodiment of the present disclosure, with side walls of grooves in the cam removed to illustrate string and cable routing paths.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

Many conventional string manufacturing processes use continuous, single-length strands. In these strings, all of the load-carrying strands in the string carry a substantially equal amount of the tensile force since tension in the string is evenly distributed through each strand, and they all have the same material properties such as stiffness, durability, or rigidity.

Aspects of the present disclosure relate to strings (e.g., a bowstring or cable) that may be made from a primary load carry structure or strands having a first length and a secondary load carry structure or strands having a second length that is different from the first length. The primary load carry structure may comprise a plurality of strands comprising or consisting of a first material, and the secondary load carry structure may comprise a plurality of strands comprising or consisting of a second material integrated with or entwined with the first material of the primary load carry structure. For example, the second material may be an additional amount of the first material that is added to the first material in the primary load carry structure or the second material may be a different material composition added to the first material. In some configurations, the secondary load carry structure may comprise bowstring strands made of the second material that extend longitudinally alongside or are entwined with the primary load carry structure. The second material may be integrated with or added to the first material on limited sections of the length of the primary load carry structure. For example, the second material may be added to the first material by wrapping the second material around the first material (e.g., as a serving material) or by entwining the material generally axially along the length of the first material.

In some embodiments, the first and second materials may comprise composite carbon fiber, aramid, or fiberglass formed into at least one strand in the bowstring or cables. Other materials may include composites of KEVLAR®, VECTRAN®, DYNEEMA® (i.e., high modulus-polyethylene material), other thermoplastic material, metal or metallic fibers, and related products. One material may comprise a carbon fiber with higher fiber or matrix content than the other material.

The first and second materials may have different mechanical properties. As a result, the combination of different materials may provide a plurality of load-carrying paths through the bowstring, wherein some of the paths are engaged to bear a first proportion of the load when a first tensile load is applied to the bowstring, and other paths are engaged to bear a second proportion of the load applied to the bowstring. For example, different paths may be engaged when a second tensile load is applied that is greater than the first tensile load, so the proportion of the load borne by each portion of the paths changes. In another example, a different proportion of the load may be borne by a first portion of the load-carrying paths when the string is under a first tensile load as compared to a second tensile load. In an example embodiment, the first portion of the load-carrying paths may bear the entirety of a first tensile load applied to the string, and the first portion of the load-carrying paths may bear half of a second tensile load applied to the string (with the second portion bearing the other half) when the second tensile load is greater than the first tensile load. In another embodiment, the first portion may bear a larger proportion of the overall tensile load relative to the second portion when the first tensile load is applied than when the second tensile load is applied. The first tensile load may be applied in a brace condition, and the second tensile load may be applied in a full-draw condition of a bow (or vice versa).

At least one strand of the string, and potentially a plurality of individual strands in the string, may be referred to as a first strand of the string, and at least a second strand of the string, and potentially a second plurality of individual strands of the string, may be referred to as a second strand of the string. The first strand in the string may have a first length, and the second strand may have a second length that is different from or unequal to the first length, at least under certain loading conditions. For example, when the string is unloaded (e.g., taken off of or separated from a bow or crossbow and placed at rest), at least the first strand may be shorter in length than the second strand. A second tensile load may be applied, such as by attaching the string to a bow or crossbow in the brace condition or a drawn condition, and the proportion of the second tensile load borne by each of the strands may be different from the proportions they each bear in the unloaded condition. For example, the proportion of the second tensile load borne by the first strand may be less than 100 percent since the second strand also bears a portion of the second tensile load. The relative lengths of the first and second strands may also change when the second tensile load is applied, such as by the first strand elongating to be closer to the length of the second strand (or even becoming equal to the length of the second strand). See FIG. 4D. Thus, the relative size of the first and second strands may change in response to the application of the second tensile load.

In another embodiment, the first strand may have a different length than the second strand when a first tensile load is applied that is non-zero, such as when the string is attached to a bow or crossbow and loaded under tension in the brace condition. For example, the first strand may be shorter than the second strand when the string is in the brace condition. The second strand may remain slightly longer or may have a small amount of slack in its length that makes it longer than the first strand. See FIG. 4C. The first strand may also bear a larger proportion of the first tensile load than the proportion of the load borne by the second strand.

A second tensile load may be applied to the string (e.g., by drawing the string), and the second tensile load may change the length of one or both of the first and second strands by elongating the shorter strand relative to the longer strand. Thus, under a second tensile load (e.g., when the string is attached to the bow and in brace condition or a draw condition), the first and second strands may potentially have equal lengths. Elastic elongation of the first strand along its longitudinal axis may allow the second strand to also elongate, take up its slack, or straighten and start to engage (or further engage) in bearing the second tensile load relative to the first tensile load. Therefore, the proportion of the second tensile load borne by the first strand may be less than the proportion of the first tensile load borne by the first strand as the second strand takes up some of the tensile load as the second tensile load is applied.

Similarly, if the first tensile load is less than the second tensile load, the first strand may begin to take proportionally more of the load as the string transitions between bearing the second tensile load and bearing the first tensile load. The first strand may longitudinally contract as the tensile load decreases, thereby causing the second strand to take on slack or otherwise have a greater length than the first strand.

In some embodiments, this may mean that each load carrying structure or different sections along the length of the bowstring have a different stiffness (e.g., different Young's Modulus), strength/durability, abrasion resistance, density, longitudinal elasticity, bending resistance (i.e., flexibility), diameter, aerodynamic properties, weighting, and other related properties. Accordingly, bowstrings and cables (collectively referred to as "strings" herein) may have softer dynamic impact loading (i.e., shock) when launching a projectile, may have increased resistance to damage from dry-fires, may be more difficult to cut, may have weight added to areas on the bowstring where it would be otherwise difficult to add weight (e.g., within the cam track or the portion of a string that contacts or slides along the cam or cable guard), may have reduced overall weight, and may have reduced vibration when operated.

Additionally, in some embodiments, the serving material circumferentially wrapped around or otherwise positioned external to the generally longitudinal load-bearing bowstring strands or other material may have specialized properties. For example, the serving material may be made with a higher density material than a longitudinal strand material. As compared to conventional string weights, the serving material may reduce the chance for stress concentrations to form while simultaneously providing improved wear resistance along the length of the string to which the serving material is applied. Weighted serving material may also be used to dynamically balance the bow by redistributing weight on the bow from parts such as the cams onto the bowstring or cables. Thus, rather than increasing the weight of the cam in order to improve the efficiency of the bow, and thus requiring the cams to be replaced, the weight of the string can be increased instead, which may be considerably less difficult and less expensive for the user or manufacturer of the bow. Weighting the bow using serving material rather than bulkier string weights may also make the string beneficially smoother, more aerodynamic, and more aesthetically pleasing. The string may also have lower or more distributed stress concentrations since the stress of additional string weights may be reduced or eliminated.

The present description provides examples, and is not limiting of the scope, applicability, or configuration set forth in the claims. Thus, it will be understood that changes may be made in the function and arrangement of elements discussed without departing from the spirit and scope of the disclosure, and various embodiments may omit, substitute, or add other procedures or components as appropriate. For instance, the methods described may be performed in an order different from that described, and various steps may be added, omitted, or combined. Also, features described with respect to certain embodiments may be combined in other embodiments.

Figure 2:
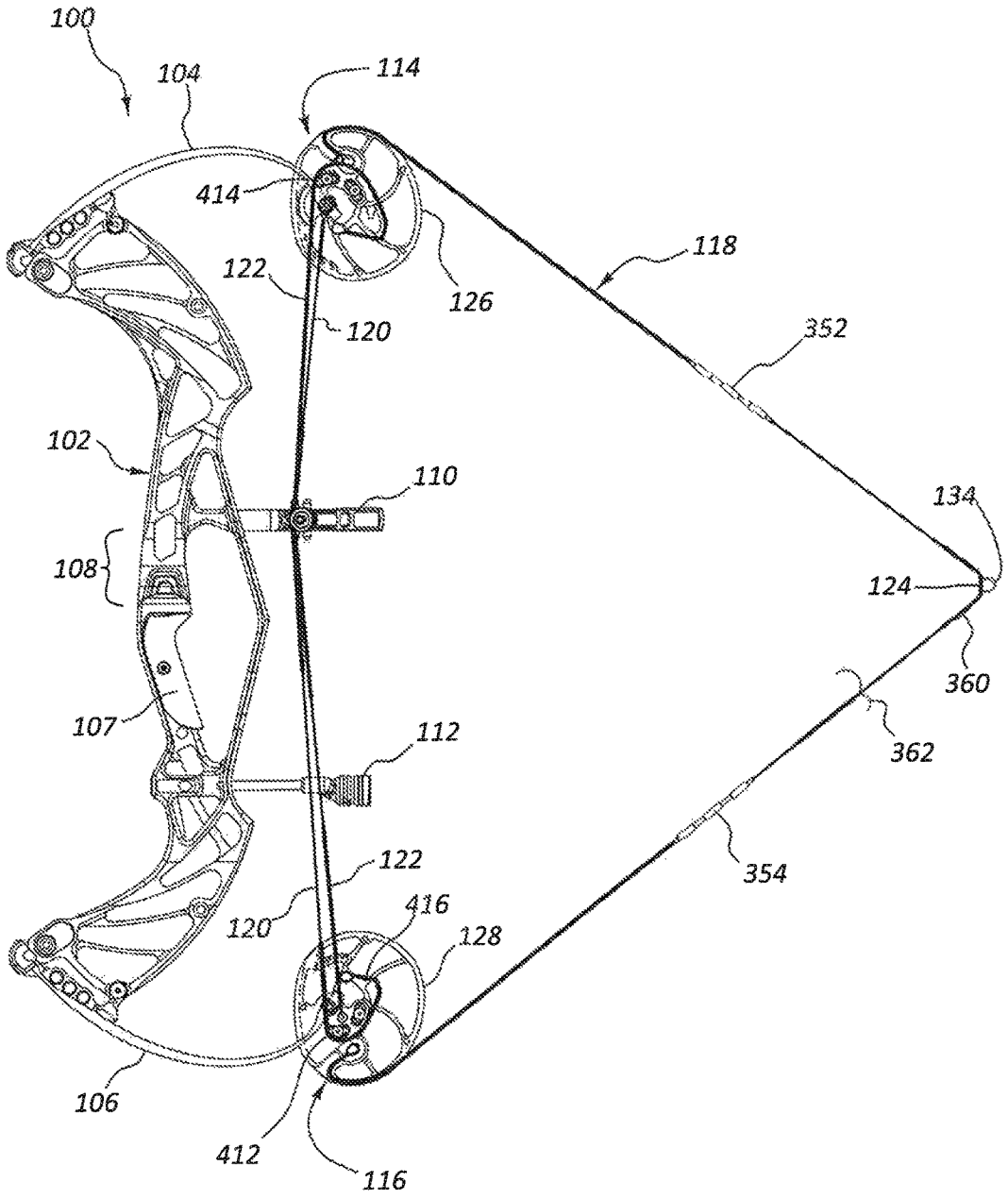
FIG. 2 is a side view of the bow of FIG. 1 in a full-draw condition.

Referring now to the figures in detail, FIGS. 1-2 show an archery bow 100 according to an embodiment of the present disclosure. In FIG. 1, the bow 100 is at a rest position (e.g., a brace position), and in FIG. 2, the bow 100 is at a fill-draw position. The bow 100 comprises a riser 102 from which upper limbs 104 and lower limbs 106 extend. The riser 102 may comprise a handle portion 107 (i.e., a grip), a sight window portion 108, a cable guard 110, a string dampener 112, and other parts and accessories commonly known in the art.

The upper limbs 104 may be connected to an upper cam 114, and the lower limbs 106 may be connected to a lower cam 116. A bowstring 118 (i.e., draw string) may extend vertically across the length of the bow 100 between the upper cam 114 and the lower cam 116 when the bow 100 is positioned upright. The terminal ends of the bowstring 118 may be attached to and held wrapped against the cams 114, 116, at least in the brace position, and the limbs 104, 106 may be flexed to retain tension in the bowstring 118. A yoked buss cable (YBC) 120 and a control buss cable (CBC) 122 may also be attached to and extend between the upper cam 114 and the lower cam 116. Collectively, the YBC 120 and CBC 122 may be referred to herein as the cables of the bow 100. The cables 120, 122 may retain tension in the limbs 104, 106 and cams 114, 116 and may be controlled to adjust tension in the bowstring 118, draw length of the bowstring 118, and other tuning features of the bow 100.

The bow 100 shown in the figures is shown for example purposes to illustrate an archery device that may be used in conjunction with the principles and teachings of the present disclosure. Thus, while the bow 100 is a compound bow, it will be understood by those having ordinary skill in the art that the features of the bowstrings, cables, and related methods and apparatuses included in embodiments of the present disclosure may be applied to strings and related methods and apparatuses in traditional bows, recurve bows, crossbows, and other related archery equipment. Similarly, archery equipment applying the teachings of the present disclosure does not need to implement all of the features of the present disclosure. For example, in some embodiments, the bow may not comprise a cable guard 110 or a string dampener 112, so features associated with those accessories may be omitted from the strings of the bow.

Figure 18:
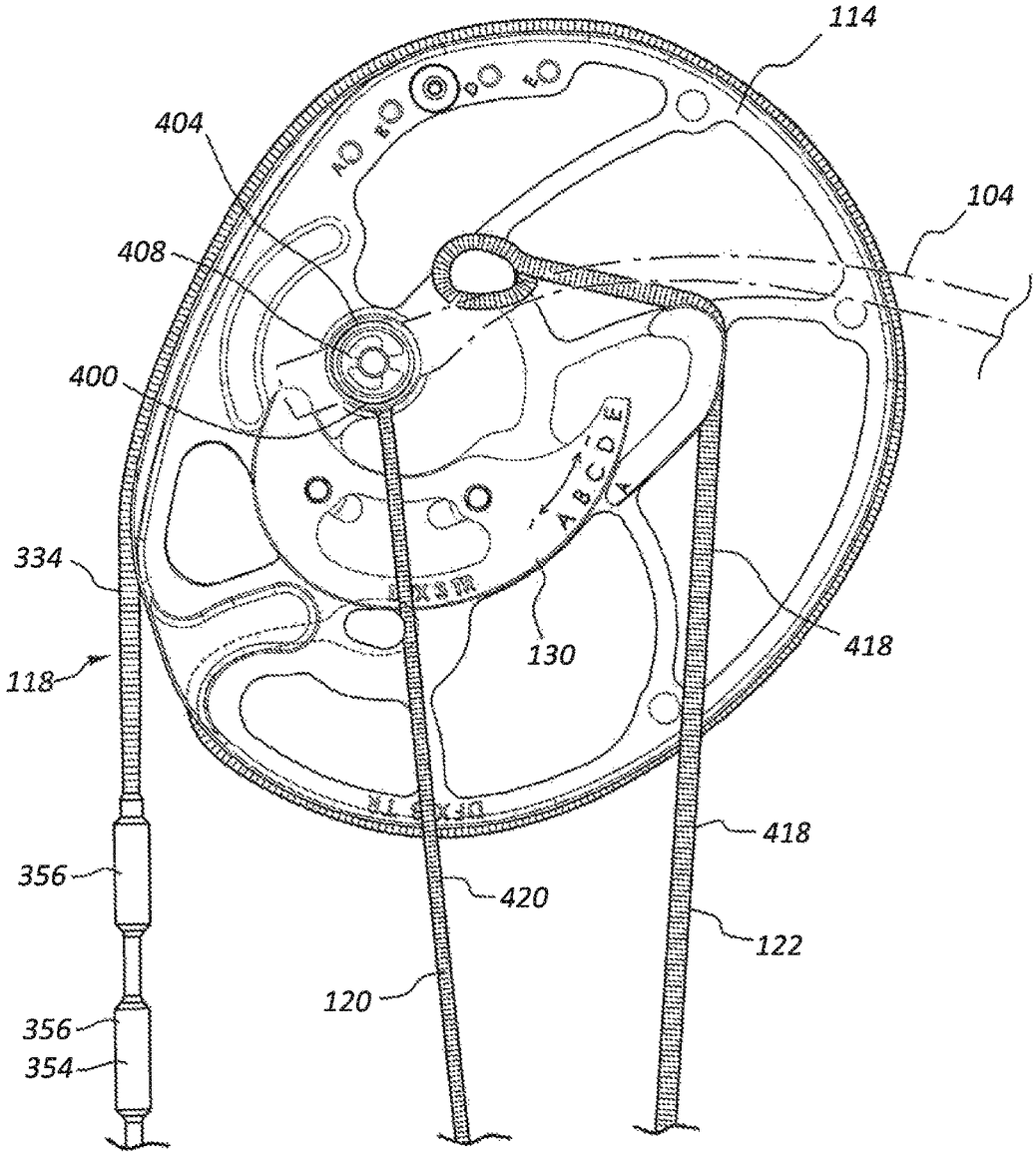
FIG. 18 shows the opposite side view of the cam, strings, and cables of FIG. 17.

When shooting an arrow, the tail end of the arrow may be nocked with the bowstring 118 at a nocking point 124 while the bow 100 is in the rest position shown in FIG. 1. The bowstring 118 may be drawn rearward to the full draw position, as shown in FIG. 2, thereby partially unraveling the bowstring 118 from the outer grooves 126, 128 (see FIG. 2) of the cams 114, 116 and winding the cables 120, 122 around cable winding support portions 130, 132 of the cams 114, 116 (see FIGS. 2, 15, and 18). The archer may grip the handle portion 107 of the riser 102 and draw back the bowstring 118 using a loop 134. As the limbs 104, 106 flex inward and the cables 120, 122 wind around the cams 114, 116, the cables 120, 122 may slide along or may be in rolling contact with portions of the cable guard 110, which may comprise at least one roller 111 or other smooth support in contact with the cables 120, 122 where they contact the cable guard 110. See FIG. 14.

When the bowstring 118 is released, the potential energy in the limbs 104, 106 is released, and the bowstring 118 quickly accelerates back toward the rest position as it applies a shooting force to the arrow. As the limbs 104, 106 release their energy, they spread apart, and the terminal ends of the bowstring 118 wrap around the cams 114, 116, and the cables 120, 122 unwind from the cams 114, 116. A portion of the bowstring 118 may come into contact with the string dampener 112, which may dampen residual vibrations in the bowstring 118, and the cables 120, 122 may roll or slide against the cable guard 110 as the cams 114, 116 move. Vibrations and reverberations in the bow 100 may dampen out, and bow 100 may return to the brace position shown in FIG. 1. In this process, the cams 114, 116 and at least one roller 111 may rotate relative to the limbs 104, 106 or cable guard 110 of the bow.

Over time, repeated use of the bow 100 may cause wear on the bowstring 118 and cables 120, 122 where they contact other parts of the bow 100. Archers also seek to avoid energy imbalances and strong vibrations that may negatively affect their aim, accuracy, the structure and tuning of the bow, and the lifespan of the strings and other parts of the bow 100. Accordingly, one aspect of the present disclosure relates to composite strings and related methods that may be used to address challenges faced by archers and bow makers.

Figure 3:
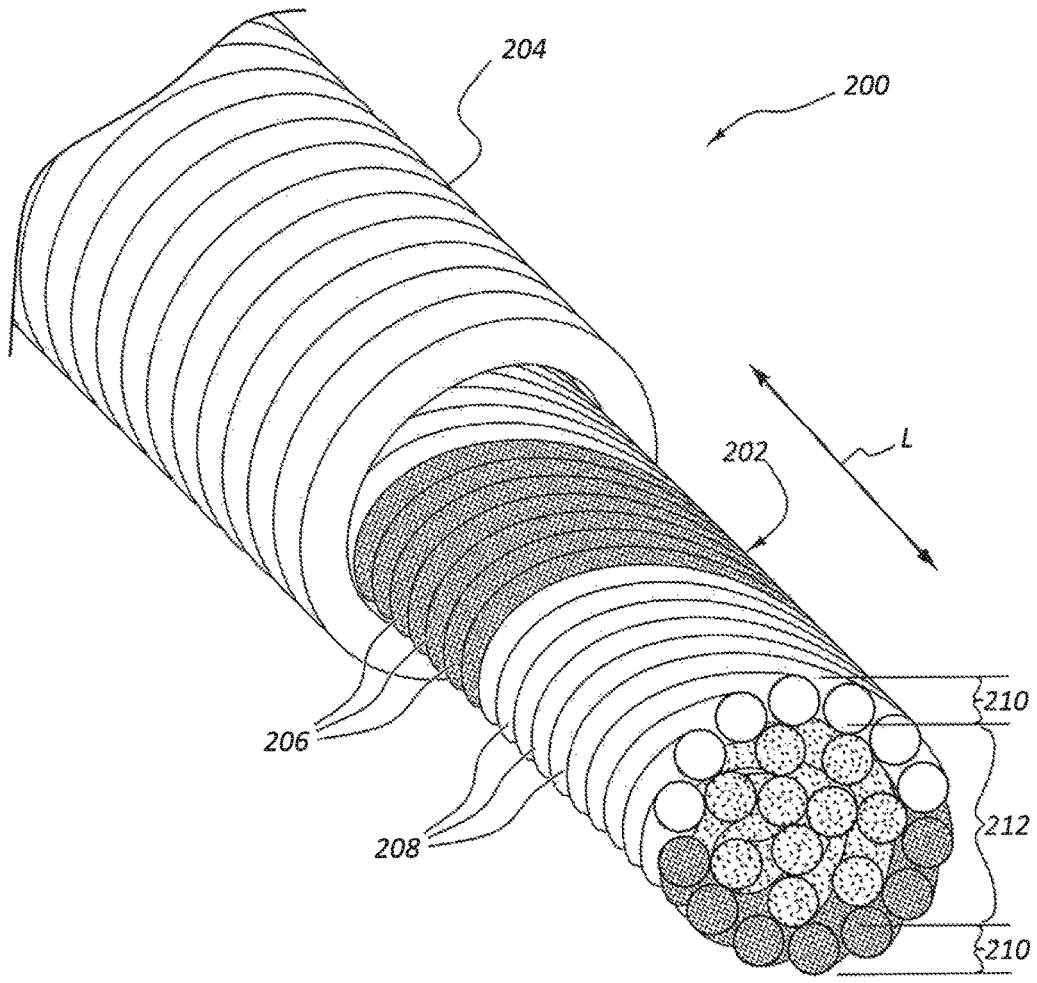
FIG. 3 is a partial section view of a composite string according to the present disclosure.
Figure 4:
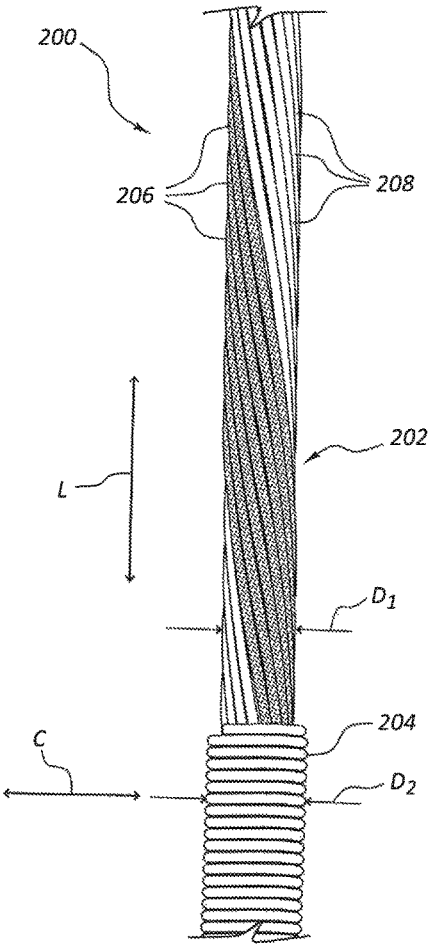
FIG. 4 is a side view of the string of FIG. 3.

FIG. 3 shows an example embodiment of a composite string 200 according to the present disclosure. The string 200 is shown in partial section view to show the internal configuration of the strands and serving material. FIG. 4 shows a side view of the string 200. The string 200 may be a bowstring (e.g., 118) or a cable (e.g., 120, 122) used in a bow (e.g., 100). The string 200 may comprise a plurality of entwined strands, including a plurality of generally longitudinal strands 202 with lengths extending predominantly along an axial or longitudinal direction L. The string 200 may also comprise at least one predominantly circumferentially or helically winding material 204 (e.g., a serving bundle or strand) that is radially external to the longitudinal strands 202 and has a plurality of successive loops made of a strand spiraling predominantly around the circumferential directions C. See FIG. 4.

The plurality of longitudinal strands 202 may be entwined and twisted together in a helical configuration, but the number of rotations per unit of longitudinal length of the helical shape of the longitudinal strands 202 may be less than the number of rotations per unit of longitudinal length of the helical shape of the helically winding material 204. For example, as shown in FIG. 4, each coil of the helically winding material 204 makes about one rotation around the longitudinal strands 202 for each unit of distance along the longitudinal length of the string 200 equal to the diameter of the strand of helically winding material 204. By comparison, each coil of the longitudinal strands 202 requires many times more than that distance (or the diameter of the longitudinal strand 202) along the longitudinal length of the string 200 to make one rotation. The longitudinal strands 202 may also differ from the helically winding material 204 because the longitudinal strands 202 may be configured to bear longitudinal tension (e.g., tension primarily in the longitudinal direction L) when the string 200 is put under a load by limbs of a bow, whereas the helically winding material 204 may not be configured to bear the longitudinal tension.

In some embodiments, the longitudinal strands 202 may comprise a first portion of strands 206 made of a first material and a second portion of strands 208 made of a second material. The first and second portions of strands 206, 208 may each extend generally longitudinally along each other and along at least a portion of the axial length of the string 200. Each of the longitudinal strands 202 may comprise a plurality of constituent strands (not shown) that make up its material composition. For example, one of the first portion of strands 206 may comprise a plurality of micro-strands which are fibers (e.g., 30% VECTRAN® fibers and 70% DYNEEMA® fibers) that may be woven together, twisted together, or bonded to each other using a matrix material. Thus, the first and second portions of strands 206, 208 may have different material compositions based on the fibers used in their constituent strands and the matrix material (if any) used to bond those fibers together to form a strand shown in FIGS. 3-4. Likewise, the first and second portions of strands 206, 208 may have different material compositions based on the concentration or proportion of the fibers or matrix material used in each strand. Alternatively, each of the longitudinal strands 202 may have homogeneous fibers or constituent strands within their individual thicknesses, even if the materials used in each of the strands 202 differs from strand to strand.

Figure 4A:
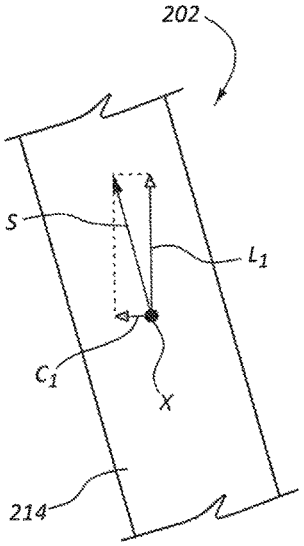
FIG. 4A is a detail side view of the string of FIG. 4.

FIG. 4A shows a detail view of the surface of the string 200 as seen from a direction facing normal to an outer surface of one of the strands 214. As used herein, a "generally longitudinal" strand refers to a strand having a directional orientation (e.g., direction of winding arrow S in FIG. 4A along the axis of the strand 214) through its center (e.g., through center point X in FIG. 4A) that extends predominantly along a longitudinal direction (e.g., along longitudinal direction L1, which is parallel to direction L) instead of predominantly along a circumferential or radial direction (e.g., circumferential direction CI, which is parallel to circumferential direction C). The first and second portions of strands 206, 208 are generally longitudinal so that they can bear longitudinal tension when the string 200 is under load. Additionally, longitudinal tension applied to the strands 206, 208 may bind and entwine the strands more tightly together rather than pulling them apart. The helically winding material 204 does not extend generally longitudinally along the string 200 because the direction of its winding is predominantly along a circumferential direction rather than a longitudinal direction.

Figure 3A:
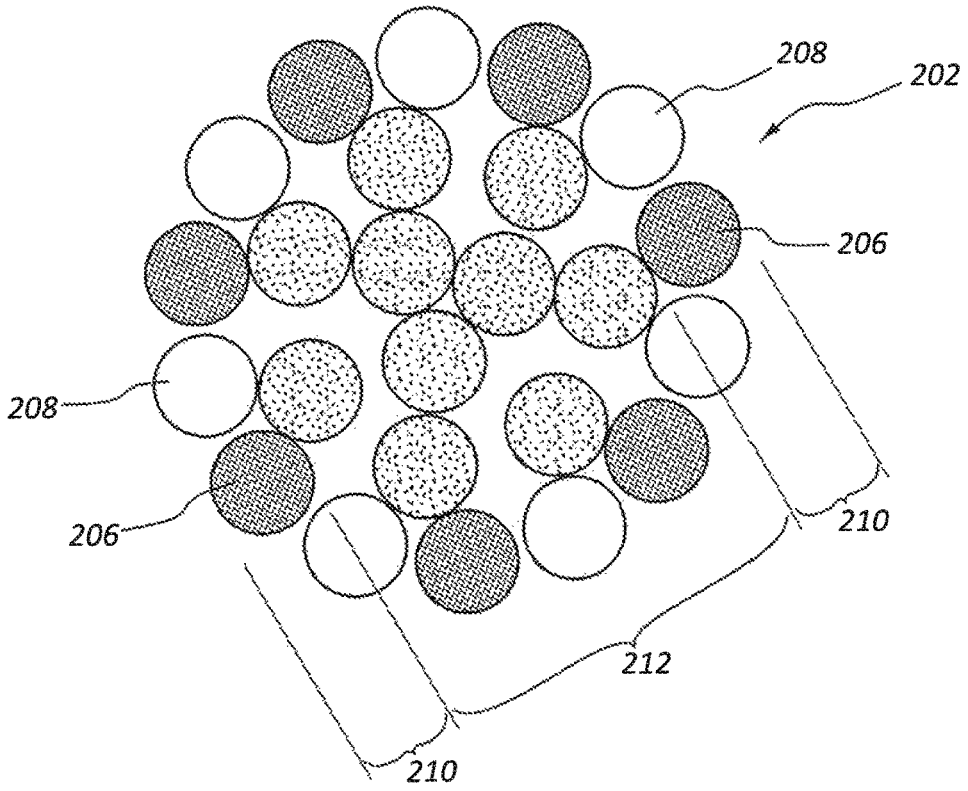
FIG. 3A is an end section view of a composite string according to another embodiment of the present disclosure.
Figure 3B:
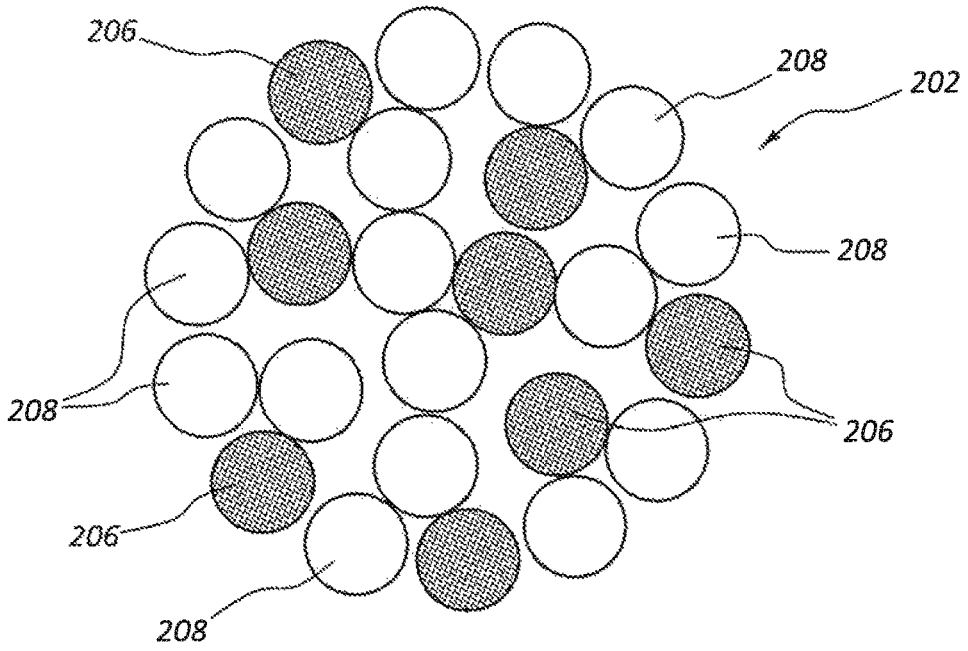
FIG. 3B is an end section view of a composite string according to another embodiment of the present disclosure.

In some embodiments, the first and second portions of the strands 206, 208 may be entwined in an alternating manner. For example, as shown in FIGS. 3 and 4, the first portion of strands 206 may be bunched together with about seven successive strands next to each other, and about seven successive strands of the second portion of strands 208 may be bunched together longitudinally adjacent to the first portion of strands 206. In other embodiments, the first and second portions of strands 206, 208 may alternate with each single strand of the first portion of strands 206 being positioned adjacent to, in between, and contacting, strands of the second portion of strands 208 on each of its sides around the string 200, as shown in FIG. 3A. The first and second portions of strands 206, 208 may be positioned in an outer layer 210 or surface layer of the longitudinal strands 202, and other strands may be positioned in an inner layer 212 or core portion of the longitudinal strands 202. In some embodiments, the first and second portions of strands 206, 208 may be distributed randomly throughout the shape of the longitudinal strands 202, as shown in FIG. 3B. Alternatively, the first and second portions of strands 206, 208 may be distributed randomly around just the outer layer 210 or just the inner layer 212.

In still other embodiments, other patterns of strands may be implemented. For example, the first and second portions of strands 206, 208 may alternate in groups of two (or some other positive integer) around the outer layer 210 or inner layer 212. Alternatively, groups of a first number of strands (e.g., three strands of the first portion of strands 206) may be followed by a second, different number of strands (e.g., two strands of the second portion of strands 208) around the circumference of the longitudinal strands 202 or in bunches throughout the cross-section of all of the longitudinal strands 202. Thus, various configurations of strand patterns may be arranged in the string 200. The different patterns may provide the string 200 with different mechanical properties since each set of strands 206, 208 may comprise different materials. Increasing the number of one type of strands relative to another type of strands may cause the bundle of strands to have properties more closely resembling the strands that are represented in higher quantities.

The string 200 may comprise first and second portions of strands 206, 208 that each have a different tensile strength, abrasion resistance (e.g., cutting resistance), density, or flexibility relative to each other. As used herein, the "flexibility" of a material refers to the material's elasticity or elastic deformability under bending loading. One type of material may be used more prevalently in the string 200 by increasing the number of strands having that material relative to the strands in the string 200 of another material. For instance, a string 200 may be made with a larger number of higher-density strands relative to a lower number of relatively lower-density strands in order to increase the overall weight of the string 200. Similarly, increasing the number of highly-abrasion-resistant strands relative to less-abrasion-resistant strands may increase the overall abrasion-resistance of the string 200. Because there are other strands in the string 200, the string 200 may be made with hybrid or composite properties that would not otherwise be possible in a string that has only one type of material in every strand.

The first and second portions of the strands 206, 208 may also be at least partially positioned internal to the outer layer of exposed strands of the bundle of strands of the string 200. For example, in some embodiments one or both of the first and second portions of strands 206, 208 may be positioned internal to an outer layer of strands 210 of the string 200, such that some of an inner layer of strands 212 may be part of the first and second portions of strands 206, 208. See, e.g., FIG. 3B. Accordingly, patterns of alternating groups of strands may be formed in a radial direction through the string 200, such as the first portion of strands 206 being positioned in a core of the string 200, the second portion of strands 208 being positioned radially external to the core, and another part of the first portion of strands 206 being positioned radially external to the second portion of strands 208. Thus, the outer layer of strands 210 may be referred to as a portion of the plurality of strands or plurality of load-carrying paths that collectively has a different radial position in the generally longitudinal strands 202 relative to a second portion of the plurality of load-carrying paths (e.g., the inner layer of strands 212).

In some embodiments, the string 200 may comprise a first material for the radially external surface layer or outer layer of strands 210, and the string 200 may comprise a second material for a radially internal core or inner layer of strands 212. The outer layer of strands 210 may be configured with a material that has a higher abrasion resistance than the material used in the inner layer of strands 212. Thus, the surface of the string 200 may be more resistant to cutting or wear from rubbing against a cable guard (e.g., 100) or cams (e.g., 114, 116) than the inner layer or inner strands. In some arrangements, at least one of the outer and inner layers of strands 210, 212 may have different elasticity in order to provide vibration dampening for the string 200 more efficiently than the other layer or in order to remain more rigid under tension than the other layer.

The inner layer of strands 212 or first portion of strands 206 may in some cases comprise a dense material, such as, for example, lead. The outer layer of strands 210 or second portion of strands 208 may comprise a less dense, more durable material, such as High Modulus Polyethylene (HMPE). The heavier core or first portion may provide weight balance and may reduce noise and vibration shock applied to the bow by changing the natural vibration frequency of the string. This configuration may also provide a softer reaction to dynamic loading when the bow is shot by reducing the loading stiffness in the dynamic loading range. A greater portion of the load carried by less stiff strands may allow for more stretch, which may also allow for softer dissipation of energy. In some embodiments, there may be a plurality of materials used in each of the individual strands of each layer of strands 210, 212. For example, the outer layer of strands 210 may comprise the first and second portions of strands 206, 208, and each of the first and second portions 206, 208 may comprise a different material relative to the other. The inner layer of strands 212 may comprise a different material relative to at least one of the first and second portions of strands 206, 208. For example, the inner layer of strands 212 may comprise a third material that differs from the material used in either of the first and second portions of strands 206, 208. Furthermore, the inner layer of strands 212 may comprise the third material and a fourth material, wherein the fourth material differs from the third material. Accordingly, the string 200 may be constructed with a plurality of materials in the strands making up the outer layer of strands 210 and a plurality of materials in the strands making up the inner layer of strands 212, and the properties of those different materials may be customized for performing different functions in different parts of the string 200, as explained elsewhere herein.

Due to the multiple materials used in the string 200, the string 200 may have dynamic properties. For example, application of a first tensile load (e.g., the loading of the bow 100 at rest) may cause only a first type or first portion of strands in the string 200 (e.g., the first portion of strands 206 or outer layer of strands 210) to bear the first tensile load (or to bear a first proportion of the first tensile load relative to other strands in the string 200). A single load-bearing path or a first set of load-bearing paths through the string 200 may bear the first tensile load or a larger proportion of the first tensile load than a second load-bearing path or second set of load-bearing paths through the string 200. A second type or second portion of strands in the string 200 (e.g., the second portion of strands 206 or the inner layer of strands 212) may not bear the first tensile load in that position or may bear a lower proportion of the first tensile load than the first type of strands. The string 200 may then also be loaded with a second tensile load, such as by drawing the bow, and both the first and second portions of strands (e.g., the first and second portions of strands 206, 208 or the outer and inner layers of strands 210, 212) may then bear the second tensile load simultaneously, or the second portion of strands may bear a larger proportion of the load than when the first tensile load is applied.

The string 200 may have these properties because the first load may be borne by a first portion of load-carrying paths through the bundle of strands and the second load may be borne by the first and second portions of load-carrying paths through the strands. The materials in the strands that make up the first and second portions of load-carrying paths may behave differently under different loads. Some of the strands may be stretched (i.e., elastically elongated) as the tensile load increases from the first tensile load to the second tensile load, and the stretching may cause the other strands and other paths through the string 200 to begin to bear a load (or to bear more of the load) as a result. Thus, the string 200 may be designed with a elongation profile or elasticity profile that is a hybrid profile that combines the properties of its multiple constituent materials, such as, for example, variable stiffness rates along a loading path. In some embodiments, the string 200 may therefore have properties that could not be achieved if all of its strands comprised a single material.

The helically winding material 204 positioned external to the longitudinal strands 202 may cover at least a portion of the longitudinal length of the longitudinal strands 202. In some embodiments, the helically winding material 204 may only cover a portion of the longitudinal length of the longitudinal strands 202. The helically winding material 204 may comprise a single strand of material wrapped around the bundle of longitudinal strands 202 once the longitudinal strands 202 are entwined, as shown in FIG. 4. Each successive loop of the helically winding material 204 may contact the previous loop of the material such that there are no gaps between the successive loops of the helically winding material 204. In this manner, the helically winding material 204 may wrap tightly around the longitudinal strands 202 and prevent abrasion or other contact between the outer surface of the longitudinal strands 202 and other parts of the bow (e.g., against a cable guard 110, string dampener 112, or one of the cams 114, 116) or other objects in the area around the bow (e.g., the archer or surrounding environment). The helically winding material 204 may increase the diameter of the string 200 where it is positioned from the diameter of the bunch of longitudinal strands 202 (e.g., $D_1$ in FIG. 4) to the combined diameter of the bunch of longitudinal strands 202 and the outer diameter of the helically winding material 204 (e.g., $D_2$ in FIG. 4). The increased diameter D2 where the helically winding material 204 is located may make the string 200 fit more snugly within grooves 126, 128 of the cams 114, 116 or at other points of contact with the rest of the bow 100.

The helically winding material 204 may comprise a different material relative to the longitudinal strands 202. In some embodiments, the helically winding material 204 may comprise the same material as at least some portion of the longitudinal strands 202. Thus, the helically winding material 204 may comprise a material with heavier weight or density than the longitudinal strands 202 in order to increase the weight of the string 200 where it is served with the helically winding material 204. In some embodiments, the helically winding material 204 may comprise a first material along a first length of the string 200 (e.g., at the upper bowstring serving material 334; see FIG. 5) and may comprise a second material along a second length of the string 200 (e.g., at the lower bowstring serving material 336; see FIG. 5). With increased weight at strategic locations on the string 200, the string 200 may have improved vibration dampening properties and heavier weight relative to a bowstring that does not have a serving material, that does not have a serving material with increased weight or density, or that does not have a serving material that has different material properties along different parts of the length of the string. Additionally, in some arrangements, the weight distribution along the string 200 may be optimized so that the longitudinal strands 202 may have a smaller diameter $D_1$ or may be made of a lighter-weight material than would otherwise be needed because the weight of the string 200 is more proportionally concentrated in the denser or heavier helically winding material 204. Properly balancing the string may improve efficiency and reduce losses caused by excessive friction and vibration.

Figure 4B:
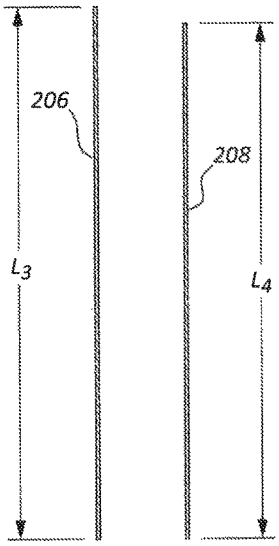
FIG. 4B is a side view of strands of the string of FIG. 4.

The first and second portions of strands 206, 208 may each have different lengths. For example, FIG. 4B illustrates an embodiment where the first portion of strands 206 has a length $L_3$ and the second portion of strands 208 has a length $L_4$. The length $L_3$ of the first portion of strands 206 is longer than the length $L_4$ of the second portion of strands 208. In this embodiment, the second portion of strands 208 may have greater elongation in a longitudinal direction than the first portion of strands 206 when tensile loads are applied to the string.

Figure 4C:
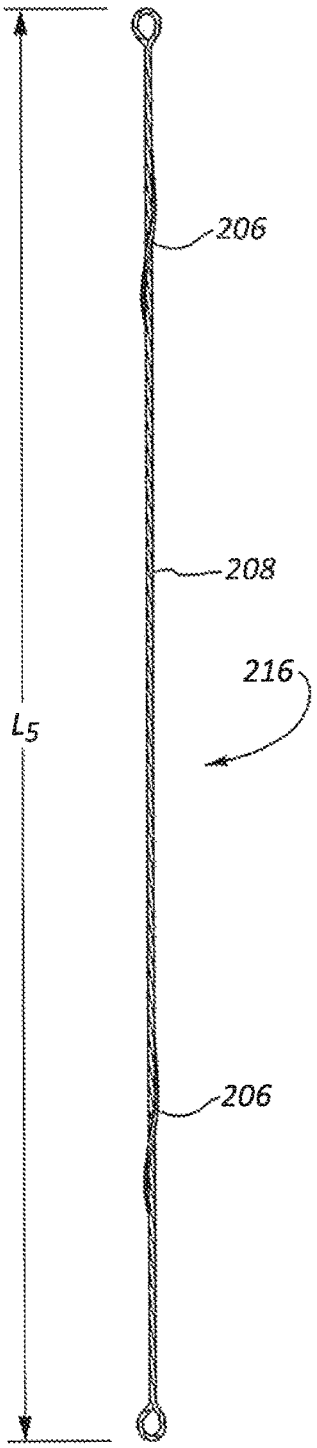
FIG. 4C is a side view of a string under a first tensile load.
Figure 4D:
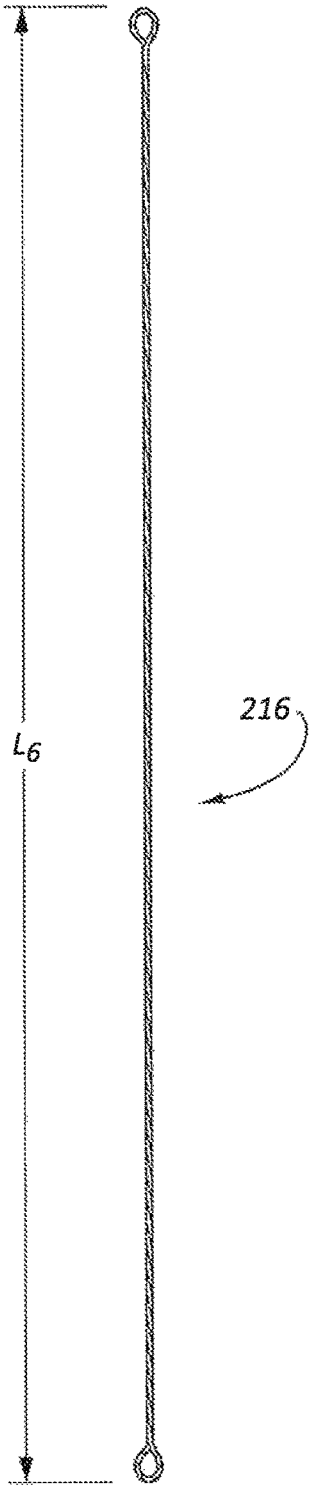
FIG. 4D is a side view of a string under a second tensile load.

FIGS. 4C-4D show a bowstring capable of illustrating an embodiment of this behavior. FIG. 4C shows a string 216 under a first tensile load that comprises the elongated first portion of strands 206 bundled and entwined with the relatively shorter second portion of strands 208. The string 216 may have an overall length $L_5$, when a first tensile load is applied to the first and second portions of strands 206, 208. Under the first tensile load, at least some of the first portion of strands 206 may have some slack or radial displacement from the remaining strands in string 216 due to the first portion of strands 206 having length $L_3$ prior to being entwined with the second portion of strands 208 which has shorter length $L_4$.

FIG. 4D shows the string 216 after a second tensile load is applied, wherein the second tensile load is greater than the first tensile load. Under the second tensile load, the string 216 has a length $L_6$ which is greater than the length $L_5$ under the first tensile load. Accordingly, the second portion of strands 208 stretches and elongates relative to the first portion of strands 206 as the load increases from the first tensile load to the second tensile load. The elongation of the string 216 may also cause the first portion of strands 206 to take up the slack and/or elongate longitudinally as well. Thus, the string 216 in FIG. 4D lacks radially-outward-lying strands in the first portion of strands 206.

In some embodiments, the first tensile load shown in FIG. 4C is the tensile load on the string 216 when the string 216 is attached to a bow or crossbow in a brace condition, and the second tensile load may be the load on the string 216 when the string is drawn or is firing an arrow (e.g., when the string is brought to full draw condition or as the arrow is leaving the string during a shot). Alternatively, the first tensile load of FIG. 4C may correspond to an unloaded condition wherein the string 216 is not attached to a bow or crossbow, and the string 216 is at rest. In that case, the second tensile load may correspond to the load applied with the string 216 at brace condition on a bow or crossbow or when the string 216 is drawn. Under the first tensile load, the second portion of strands 208 may bear a first proportion of the first tensile load relative to the first portion of strands 206. Typically, this first proportion is greater than the proportion of the load borne by the first portion of strands 206. Under the second tensile load, the second portion of strands 208 may bear a second proportion of the second tensile load relative to the first portion of strands 206, wherein the second proportion is less than the first proportion because the first portion of strands 206 is bearing more of the total load under the second tensile load than it was bearing under the first tensile load.

For the embodiments shown in FIGS. 4B-4D, the first and second portions of strands 206, 208 may each be referred to as a "strand," wherein each of the "strands" may comprise a plurality of individual strands (as shown in FIG. 4). Thus, a "first strand" may comprise a plurality of strands of the first or second portions of strands 206, 208, and a "second strand" may comprise at least some of the strands that are not part of the first strand. A first strand may be shorter than a second strand, meaning the first strand may comprise at least one individual strand that is shorter than the individual strands that collectively comprise the second strand.

Figure 5:
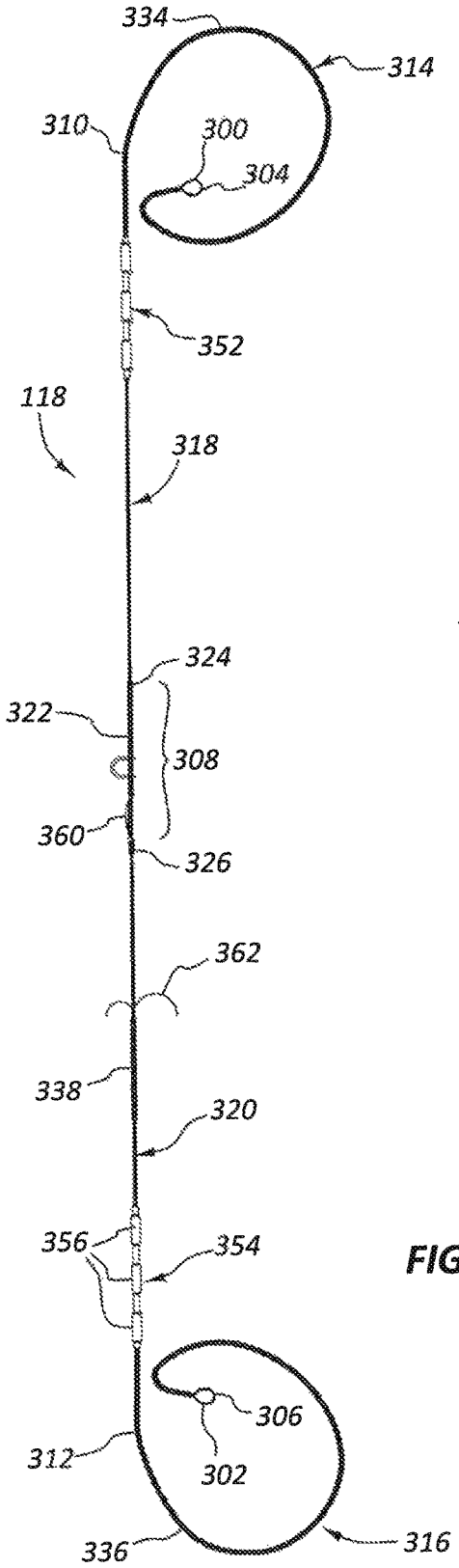
FIG. 5 is a side view of a bowstring according to an embodiment of the present disclosure.
Figure 6:
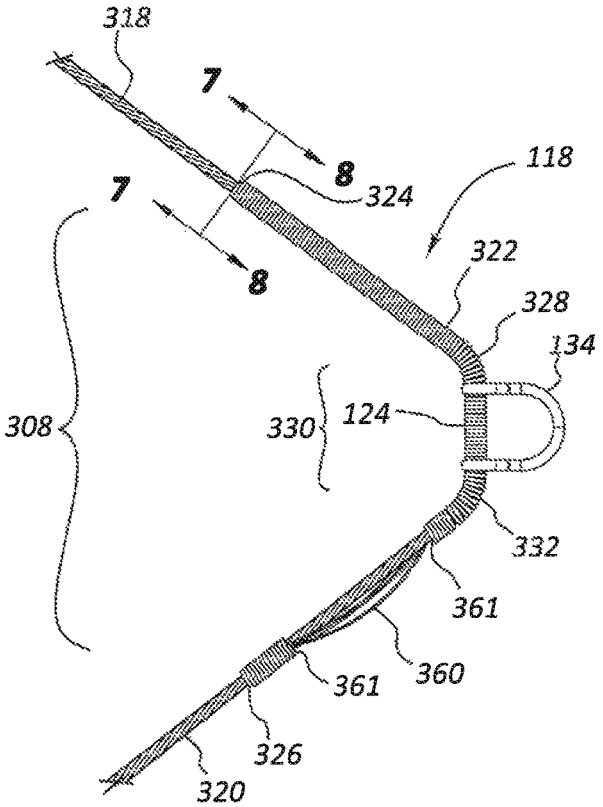
FIG. 6 is a detail view of a nocking portion of a bowstring at full draw according to an embodiment of the present disclosure.
Figure 16:
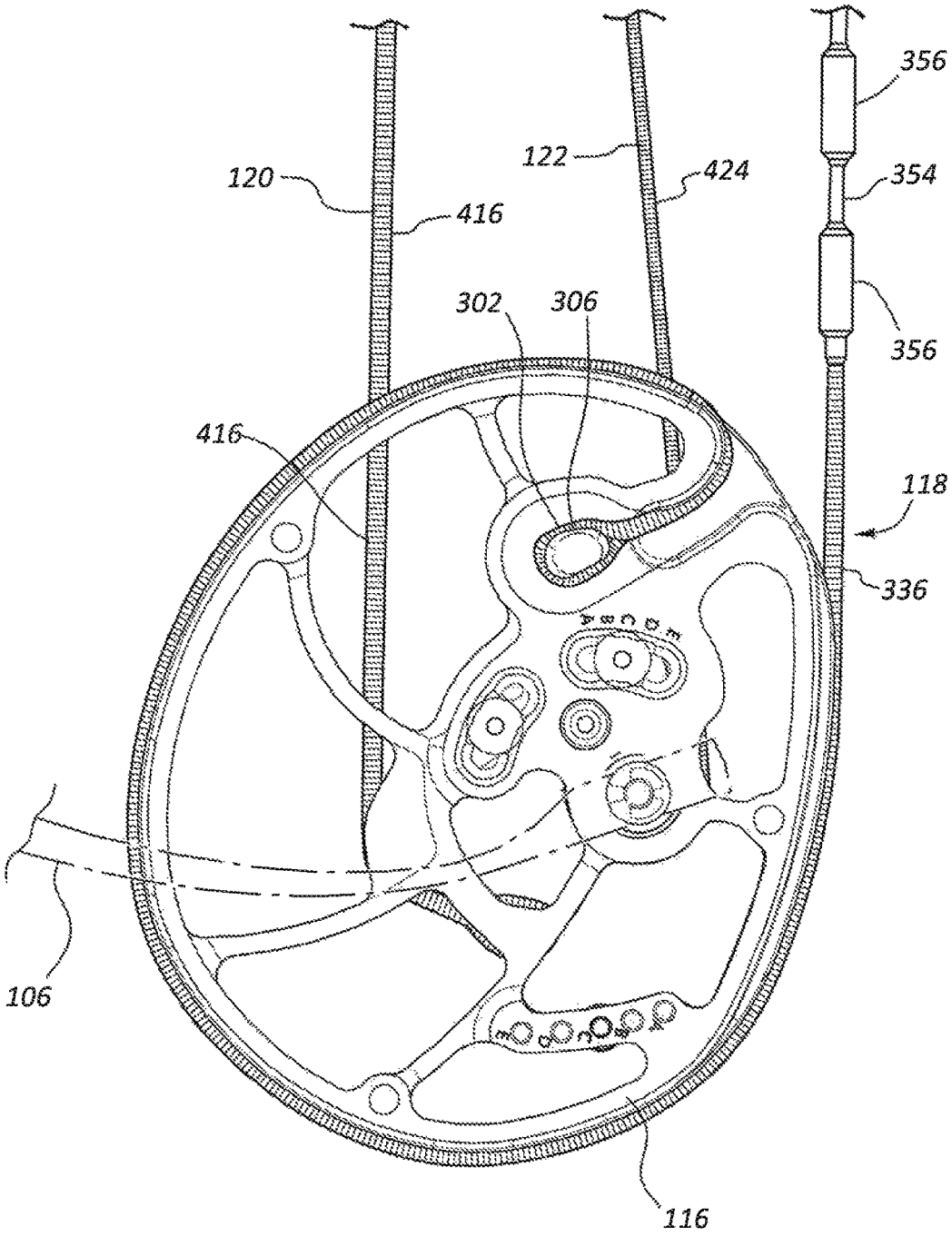
FIG. 16 shows the opposite side view of the cam, strings, and cables of FIG. 15.
Figure 17:
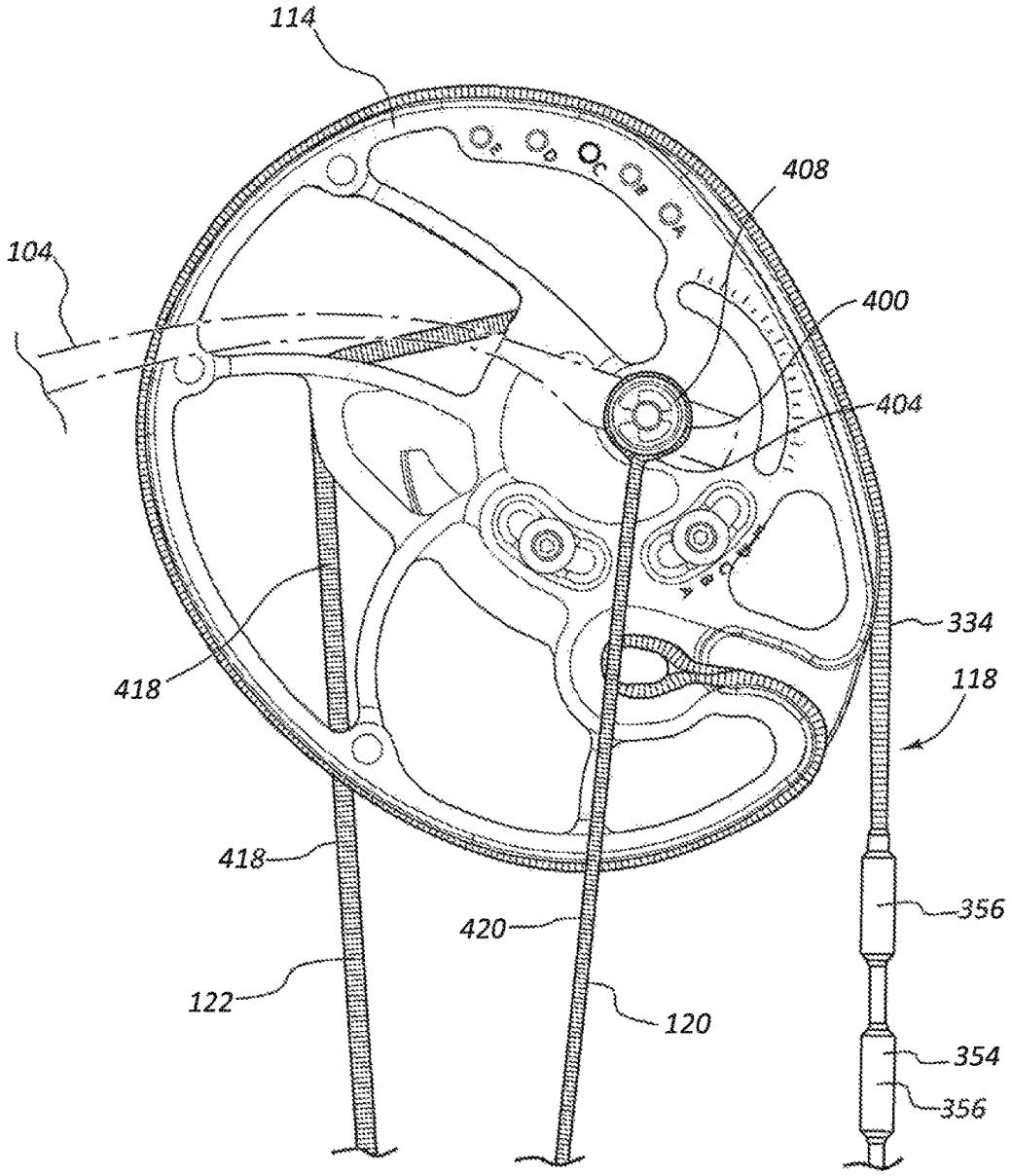
FIG. 17 shows a side view of an upper cam, strings, and cables according to an embodiment of the present disclosure, with a side wall of the upper cam removed.

FIGS. 5-12 show how various aspects of the composite string 200 may be implemented in the bowstring 118 of the bow 100 according to an embodiment of the present disclosure. FIG. 5 shows the bowstring 118 separated from the rest of the bow 100 in a brace condition. The bowstring 118 may comprise a first end 300 and a second end 302, with the first end 300 comprising a first loop 304 (i.e., teardrop) and the second end comprising a second loop 306. The first and second loops 304, 306 may each be configured to wrap around or be retained by portions of at least one of the cams 114, 116. See FIGS. 16 and 18. A nocking portion 308 may be positioned between the first and second ends 300, 302, and the nocking point 124 and loop 134 may be positioned on the nocking portion 308. The nocking portion 308 may be referred to as a bending portion of the bowstring 118 since it is configured to bend when an arrow is shot from the bowstring 118. FIG. 6 shows a detail side view of the nocking portion 308 at full draw. In some embodiments, the nocking portion 308 may be at the center of the bowstring 118, centered between the cams 114, 116, or configured on the bowstring 118 in a position centered on and horizontally aligning with an arrow rest on the riser 102.

As shown in FIGS. 1 and 5, the bowstring 118 may comprise an upper tangency point 310 and a lower tangency point 312. The upper and lower tangency points 310, 312 may correspond to the positions on the bowstring 118 that are tangent with their respective cams 114, 116 when the bow 100 is in a rest or brace condition. In other words, the upper and lower tangency points 310, 312 may be the points on the bowstring 118 where the bowstring separates from contact with the surfaces of the cams 114, 116 in the brace condition. The bowstring 118 may comprise an upper cam-contacting portion 314 having a length extending between the first end 300 and the upper tangency point 310 and a lower cam-contacting portion 316 having a length extending between the second end 302 and the lower tangency point 312.

The bowstring 118 may also comprise an upper straight section 318 extending between the upper tangency point 310 and the upper end of the nocking portion 308 and a lower straight section 320 extending between the lower end of the nocking portion 308 and the lower tangency point 312. The upper end point 324 of the nocking portion 308 may be positioned at the end of a serving material 322 served around the upper area of the nocking portion 308. See FIGS. 5-6. Similarly, the lower end point 326 of the nocking portion 308 may be positioned at the bottom end of the serving material 322. In some embodiments, the upper end point 324 may be positioned within the serving material 322 (e.g., between the nocking point 124 and the upper end of the serving material 322) or may be positioned between the end of the serving material 322 and the upper tangency point 310. Similarly, the lower end point 326 may be positioned at another position between the nocking point 124 and the lower tangency point 312. In some embodiments, the upper straight section 318 may extend between the upper tangency point 310 and the upper end point 328 of a flexible section 330 of the nocking portion 308. See FIG. 6. The lower straight section 320 may extend between the lower tangency point 312 and the lower end point 332 of the flexible section 330.

The bowstring 118 may also comprise an upper bowstring serving material 334 covering the upper cam-contacting portion 314 and a lower bowstring serving material 336 covering the lower cam-contacting portion 316. See FIGS. 5 and 16-19. The lower straight section 320 may comprise an intermediate bowstring serving material 338 at a portion of the lower straight section 320 configured to contact a string dampener (e.g., 112).

Figure 7:
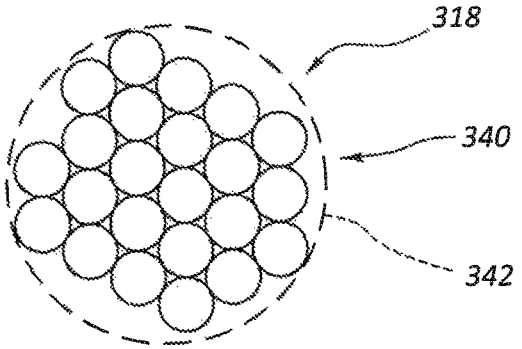
FIG. 7 is an end section view of a string according to an embodiment of the present disclosure.

In some embodiments, the upper straight section 318 and lower straight section 320 may each be more resistant to bending loads (i.e., less flexible) than the upper and lower cam-contacting portions 314, 316 of the bowstring 118. The upper and lower straight sections 318, 320 may also be more rigid than the nocking portion 308, at least outside of the flexible section 330 thereof. The straight sections 318, 320 may be made more rigid than the other portions 308, 314, 316 of the bowstring 118 by constructing the straight sections 318, 320 with additional thickness or by adding additional material to the strands that extends through those sections 318, 320. For example, FIG. 7 shows a cross-sectional view of the bowstring 118 at upper end point 324 facing toward the upper tangency point 310. As shown in FIG. 7, the upper straight section 318 may comprise a generally circular bundle of strands 340. In the pictured embodiment, there are 23 strands in that portion of the upper straight section 318 that fit within a circular profile shape 342. Other numbers of strands may be used. The bundle of strands 340 may have a stiffness or rigidity determined by their material composition (as described above in connection with the strings 200 of FIGS. 3-4) and any materials used to bond the strands to each other or create a matrix around strands.

Figure 8:
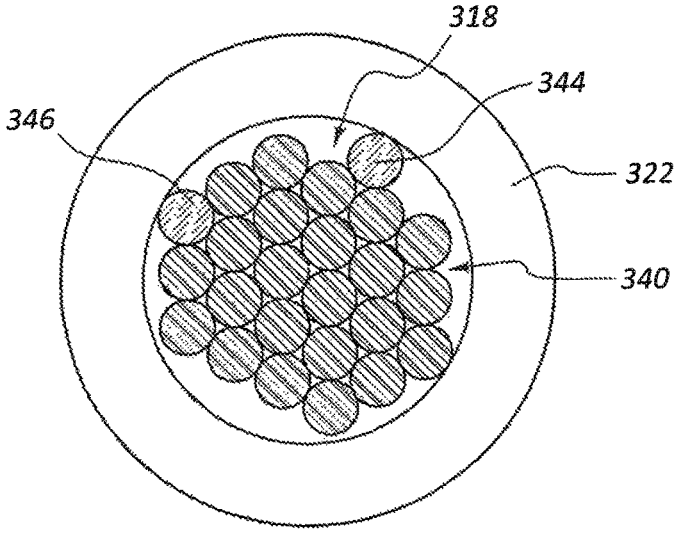
FIG. 8 is an end section view of a string according to an embodiment of the present disclosure.

FIG. 8 shows a cross-sectional view of the bowstring 118 at upper end point 324 facing axially along the bowstring 118 toward the upper end point 328 of the flexible section 330 of the nocking portion 308. In FIG. 8, there are additional strands 344, 346 added to the bundle of strands 340. The additional strands 344, 346 increase the thickness of the bowstring 118, thereby reducing its flexibility, and may comprise a different, more rigid material than the rest of the strands. In some embodiments, the additional strands 344, 346 may extend along the entire length of at least the straight sections 318, 320 or may be positioned on the bowstring 118 localized at different portions. For example, the additional strands 344, 346 may be woven into or entwined with strands of the bowstring 118 along a portion of the overall length of the bowstring 118. Alternatively, the additional strands 344, 346 may be added to the other strands of the bowstring 118 by an adhesive or related bonding technique. In some embodiments, the additional strands 344, 346 may be attached to the other strands by serving material (e.g., 322) being tightly wrapped around the outside of the collective bundle such that the additional strands 344, 346 are prevented from moving relative to the other strands by the serving material. The additional strands 344, 346 may be applied to a bundle of strands 340 having a lower number of strands than would be conventionally used, such as a 20-strand bundle, and the additional strands 344, 346 may be strategically applied to portions of the bundle of strands 340 that are susceptible to wear or breakage, that require additional stiffness, thickness, or other different material properties. In this manner, the string as a whole may be lighter and may require less material to produce since strength and weight are localized on the string only where they are most needed. Some portions of the string that may bear higher stress concentrations than others, and therefore may use additional strands 344, 346 for reinforcement, may include the areas on the string immediately around the upper and lower tangency points 310, 312 (or the tangency points 412, 414 on the cables 120, 122; see FIGS. 12 and 13), the end loops 304, 306 (and loops 404, 406, 407, 409 on the cables 120, 122), the nocking portion 308, and portions of the strings 118, 120, 122 configured to contact the cable guard 110 and string dampener 112.

In some embodiments, the bundle of strands 340 may comprise a first material composition in the straight sections 318, 320 and may comprise a second material composition in the cam-contacting portions 314, 316. For example, the strands may be constructed of a composite material (e.g., fiber material suspended in a matrix material) wherein the concentration or density of one part of the composite material (e.g., carbon fibers) is higher in the straight sections 318, 320 than in other portions of the bowstring 118. The higher density in the straight sections 318, 320 may increase the rigidity of those sections relative to the other portions of the string. In another example embodiment, the bowstring may comprise a coating or matrix material 348 surrounding the strands 350, as shown in the section view of FIG. 9. The matrix material 348 may comprise a resin coating, epoxy coating, or related material that may be applied to portions of the bowstring to increase the weight, thickness, and durability of the bowstring.

The matrix material 348 may be applied in addition to, or in the place of, serving material on the bowstring 118. In some embodiments, the strands 350 may be spaced apart from each other, wherein the matrix material 348 fills spaces between the strands (e.g., 351). Thus, the string may be more dense within its generally circular profile shape 342, and the strands 350 may be prevented from directly contacting each other. The matrix material 348 may help to more evenly distribute the tensile load among the strands 350, and may bear a percentage of the load. The matrix material 348 may also seal and waterproof the bundle of strands 350 so that they are prevented or inhibited from absorbing moisture. In this manner, the weight of the bowstring 118 may be more consistent in wet conditions since it is less likely to retain water weight.

Figure 9:
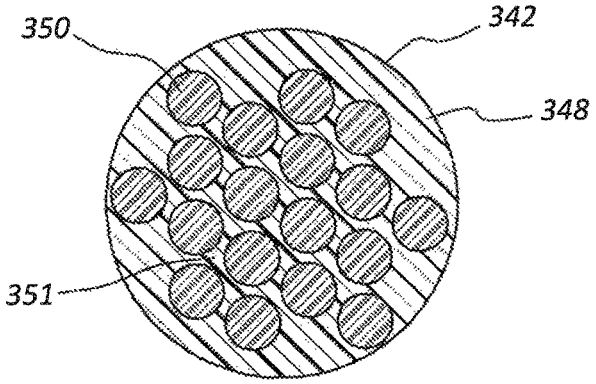
FIG. 9 is an end section view of a string according to an embodiment of the present disclosure.

FIGS. 7-9 also illustrate how strings of the present disclosure may comprise a variable cross-section. Some of the size dimensions (e.g., width, diameter) of the bundle of strands 340 of FIG. 7 are smaller than the same size dimensions of the bundle of strands 340 plus the additional strands 344, 346 shown in FIG. 8. Similarly, the size dimensions of the embodiment of FIG. 9 are different from the size dimensions of the embodiments of FIGS. 7 and 8. Accordingly, additional strands 344, 346 may be partial length strands used to increase the thickness of the bundle of strands 340 along certain portions of the length of the string, such as at portions of the string configured to be subjected to higher stress concentrations than others. The additional strands 344, 346 may also be used to change the size dimensions of the string to affect sound dampening properties of the string or to change the flexibility of the string. By integrating more strands to a portion of the length, that portion of the length of the string may be stiffer than other portions or may be more aerodynamic or more effective at vibration dampening than other portions.

In some embodiments, the bowstring 118 may comprise a plurality of weight assemblies 352, 354. See FIGS. 1, 2, 5, and 10. The weight assemblies 352, 354 may be used to strategically increase the weight of the bowstring 118 in order to improve the speed performance of the bow or to help dampen noise and vibrations. The weight assemblies 352, 354 may be positioned extending around the strands of the bowstring 118, as shown in FIG. 10, which is a side section view.

Figure 10:
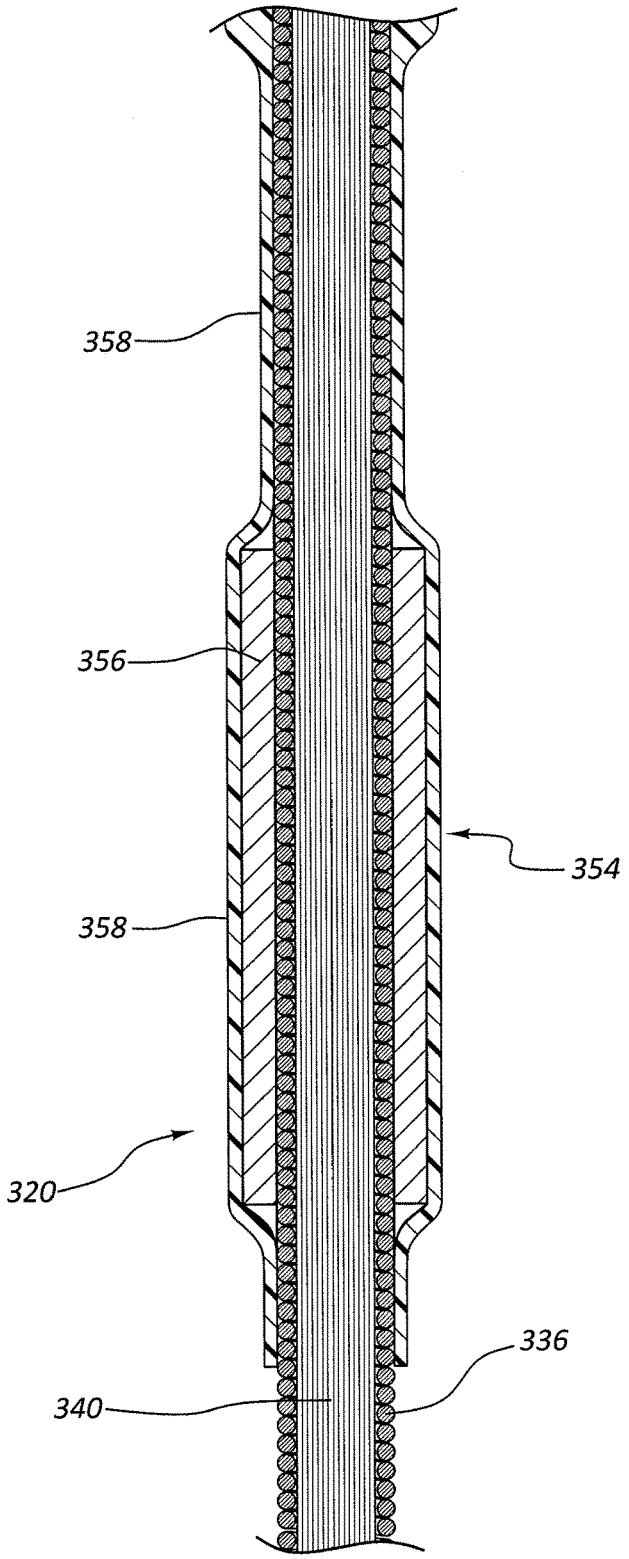
FIG. 10 is a side section view of a string according to an embodiment of the present disclosure.

In FIG. 10, the lower bowstring serving material 336 is shown covering the bundle of strands 340 of the lower straight section 320 of the bowstring 118. The weight assembly 354 may be positioned radially external to the lower bowstring serving material 336 and the bundle of strands 340. Thus, in some cases the weight assembly 354 may be removed from the bowstring 118 without removing the lower bowstring serving material 336. In some embodiments, the weight assembly 354 is adhered or otherwise bonded to the lower bowstring serving material 336 or internal bundle of strands 340. In some cases, the weight assembly 354 may be intertwined with the bundle of strands 340.

The weight assembly 354 may comprise a plurality of spaced-apart weight segments 356. See FIG. 5. The weight segments 356 may be generally cylindrical in shape, as shown in FIG. 10, and may have a hollow interior through which the lower bowstring serving material 336 and bundle of strands 340 extend. Each of the spaced-apart weight segments 356 may comprise materials with different size dimensions or density so that the user can control the overall weight of the weight assembly 354 and can control the position of the centroid of the weight assembly on the bowstring 118. The spaced-apart weight segments 356 may be linked to each other and may be held to the lower bowstring serving material 336 and bundle of strands 340 using a bonding material or wrap 358 that covers the weight segments 356 and the bowstring within the weight segments 356. See FIG. 10. In some arrangements, the materials used in the wrap 358 and weight segments 356 may be lighter or smaller in size than those used with conventional bowstrings due to the bundle of strands 340 or lower bowstring serving material 336 having a higher weight or density than conventional bowstrings. Thus, the weighting function of the weight assembly 354 may be transferred at least in part to the weight of the bowstring strands or serving material. The weight assembly 354 may also be attached to the upper straight section 318 of the bowstring 118.

The bowstring 118 may be configured with a plurality of low-tension or free-ended strands referred to herein as silencing strands. The silencing strands may comprise one or more low-tension strands 360 that have first and second ends 361 connected or bound to the bundle of strands 340. See FIG. 6. The silencing strands may comprise one or more free-ended strands 362 that have one of their ends 363 connected or bound to the bundle of strands 340, and their opposite ends 364 free-hanging. See FIGS. 5 and 11. The connected or bound ends 361, 363 of the silencing strands 360, 362 may be connected to the bundle of strands 340 by serving material, such as the intermediate bowstring serving material 338 and the serving material 322 of the nocking portion 308. The connected or bound ends 361, 363 of these strands 360, 362 may be tightly held against or adhered to the bundle of strands 340 in a manner preventing the connected or bound ends from coming loose when the bowstring 118 is used. The bound ends 361 of the low-tension strands 360 may be securely held to the bundle of strands 340 such that tension applied to the bundle of strands 340 may at least partially be held by the low-tension strands 360 as well. When the bow goes through a draw cycle, the low-tension strands 360 and free-ended strands 362 may flutter, similar to a whisker of a cat, wherein they may absorb tension in the string, then relax tension, and repeat several times (e.g., 5-6 times) during the shot to help dampen vibration and noise in the bowstring 118. For this reason, the silencing strands 360, 362 may help to silence the bowstring 118. The silencing strands 360, 362 may, however, be used for purposes aside from silencing the bowstring 118, such as, for example, increasing the weight of the bowstring 118 at certain positions or providing a visual indicator of the bowstring 118. In some embodiments, silencing strands 360, 362 may comprise dense material such as metal or rubber.

Figure 11:
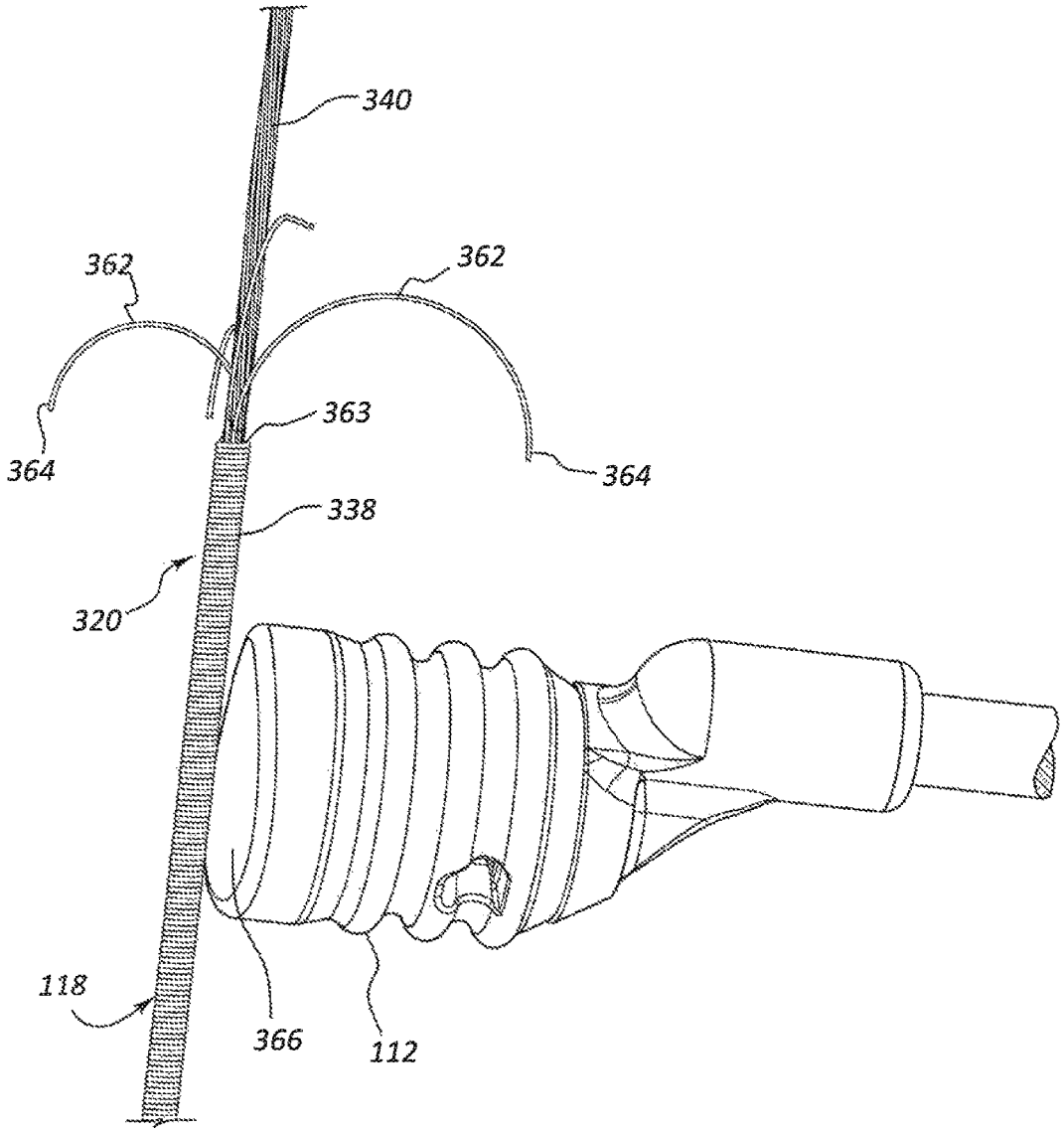
FIG. 11 is a view of a bowstring and a string dampener according to an embodiment of the present disclosure.

The low-tension strands 360 may splay or spread laterally or radially outward from the rest of the bundle of strands 340 in a manner forming a plurality of arches or parabolic shapes relative to the central axis of the rest of the bundle of strands 340. See FIG. 6. The free-ended strands 362 may spread laterally or radially outward from the rest of the bundle of strands 340, and the free ends 364 may point laterally outward or downward, as shown in FIG. 11, thereby forming loose arc shapes based on the flexibility of the free-ended strands 362 and the effects of gravity drawing the free ends in a gravitational direction.

The silencing strands 360, 362 may comprise a different material composition than the bundle of strands 340 (or at least a different material composition than at least one of the plurality of strands in the bundle of strands 340, as explained above). In some cases, the silencing strands 360, 362 may comprise a different material composition than at least one of the strands in the bundle of strands 340 that has a load-carrying path extending through it. The different material of the silencing strands 360, 362 may be configured to be more flexible and elastic than the material in the bundle of strands 340 in order to enhance the sound-dampening qualities of the silencing strands 360, 362. In some configurations, the silencing strands 360, 362 may comprise a different color (e.g., a brighter color) than the bundle of strands 340 or the surrounding serving material (e.g., 322, 338) in order to make the silencing strands 360, 362 more visible.

In some embodiments, the silencing strands 360, 362 may be positioned at the nocking portion 308 and near the string dampener 112, as shown in FIG. 5. The silencing strands 360, 362 may alternatively be positioned elsewhere on the bowstring 118. In some cases, the silencing strands 360, 362 may be configured on the bowstring 118 out of the archer's field of view through the sight window portion 108 of the bow 100 or an attached peep sight when he or she is shooting the bow 100. In some cases, the silencing strands are configured to be anywhere on the bowstring 118 aside from the cam-contacting portions 314, 316. In some embodiments, the silencing strands 360, 362 may be added to the exterior of the bundle of strands comprising the first and second portions of strands 206, 208. The silencing strands 360, 362 may extend along a small portion of the first and second portions of strands 206, 208, such as only along a segment of the length of the string that is configured to be straight when the bow is in a full-draw or brace condition. In contrast, the lower-tension strands or longer strands in the bundle of strands (e.g., strands 206 in string 216 in FIG. 4C) may extend along substantially the entire length of the higher-tension portion of strands 208. The silencing strands 360 may bear even less tension than a portion of strands that has less tension (e.g., 206 in FIG. 4C) than another portion of the strands (e.g., 208 in FIG. 4C).

In some embodiments, only one type of the silencing strands 360, 362 may be used, such as only the low-tension strands 360 or only the free-ended strands 362 being positioned on the bowstring 118. In other configurations, the bowstring 118 may comprise free-ended strands 362 where the low-tension strands 360 are located, or vice versa. The bowstring 118 may also have two or more sets of free-ended strands 362, such as some free-ended strands being positioned near the string dampener 112 (as shown in FIG. 5), and other free-ended strands being positioned near the nocking portion 308. Similarly, two or more sets of low-tension strands 360 may be attached to the bowstring 118 in those positions.

In some embodiments, the silencing strands 360, 362 extend along at least a portion of the length the bundle of strands 340. In other words, some of the strands in the bundle of strands 340 may have a free end that is not entwined with the rest of the bundle of strands 340, and that free end may be one of the free-ended strands 362. Similarly, at least one of the strands in the bundle of strands 340 may have reduced tension along at least some portion of its length so that it extends laterally or radially away from the rest of the bundle of strands 340 to form the low-tension strands 360.

If the silencing strands 360, 362 extend along the length of the bundle of strands 340 beyond where they are radially spaced away from the bundle, the silencing strands 360, 362 may not terminate at the connected or bound ends 361, 363. Instead, the silencing strands 360, 362 may extend further along the length of the bowstring 118, potentially through the serving material or even entwined with the rest of the bundle of strands 340 beyond the serving material. Thus, the additional strands 344, 346 shown in FIG. 7 may comprise one or more of the silencing strands 360, 362 extending along the length of the rest of the bundle of strands 340. As a result, the silencing strands 360, 362 may be used to increase the thickness or weight of the bowstring 118 where the silencing strands 360, 362 run alongside the rest of the bundle of strands 340 or may be used to decrease the thickness or weight of the bowstring 118 where the silencing strands 360, 362 are separated from the rest of the bundle of strands 340.

The bowstring 118 may be configured to come into contact with a string-facing surface 366 of a string dampener 112. See FIG. 11. The portion of the bowstring 118 contacting the string-facing surface 366 may comprise the intermediate bowstring serving material 338. Because contact with the string dampener 112 may cause wear on the bowstring 118, the intermediate bowstring serving material 338 may comprise a durable material that is not quickly worn out over time as it comes into contact with the material at the end of the string dampener 112.

Figure 12:
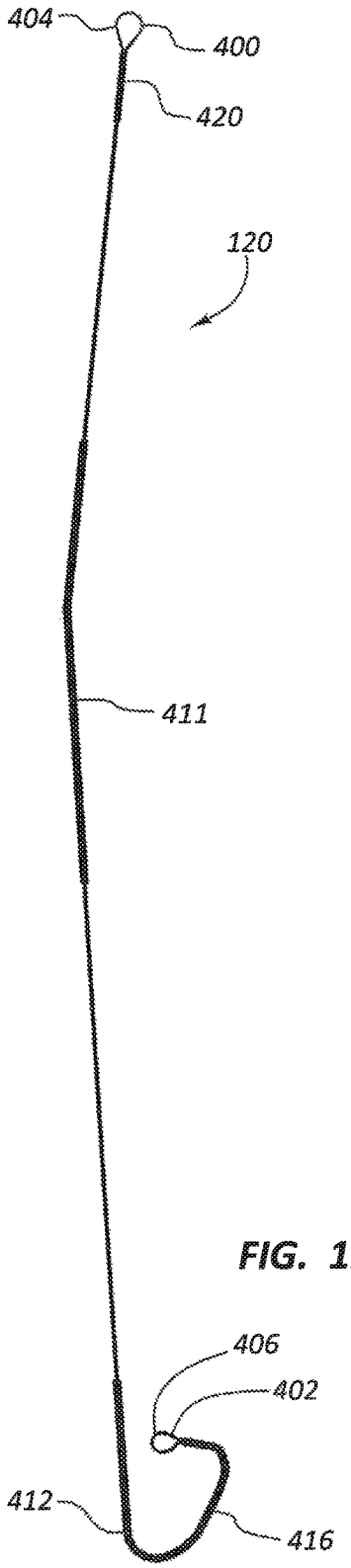
FIG. 12 is a side view of a cable according to an embodiment of the present disclosure.
Figure 13:
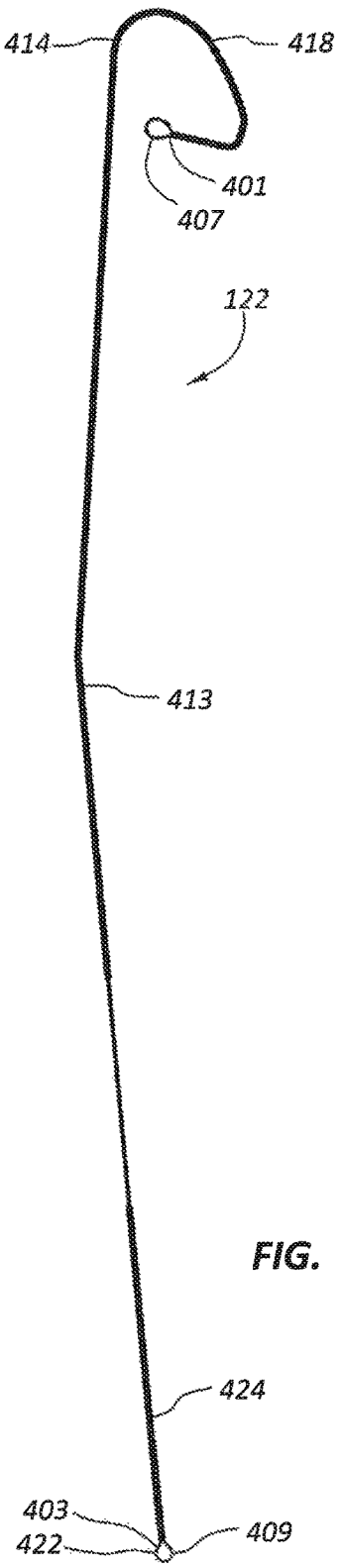
FIG. 13 is a side view of a cable according to an embodiment of the present disclosure.
Figure 14:
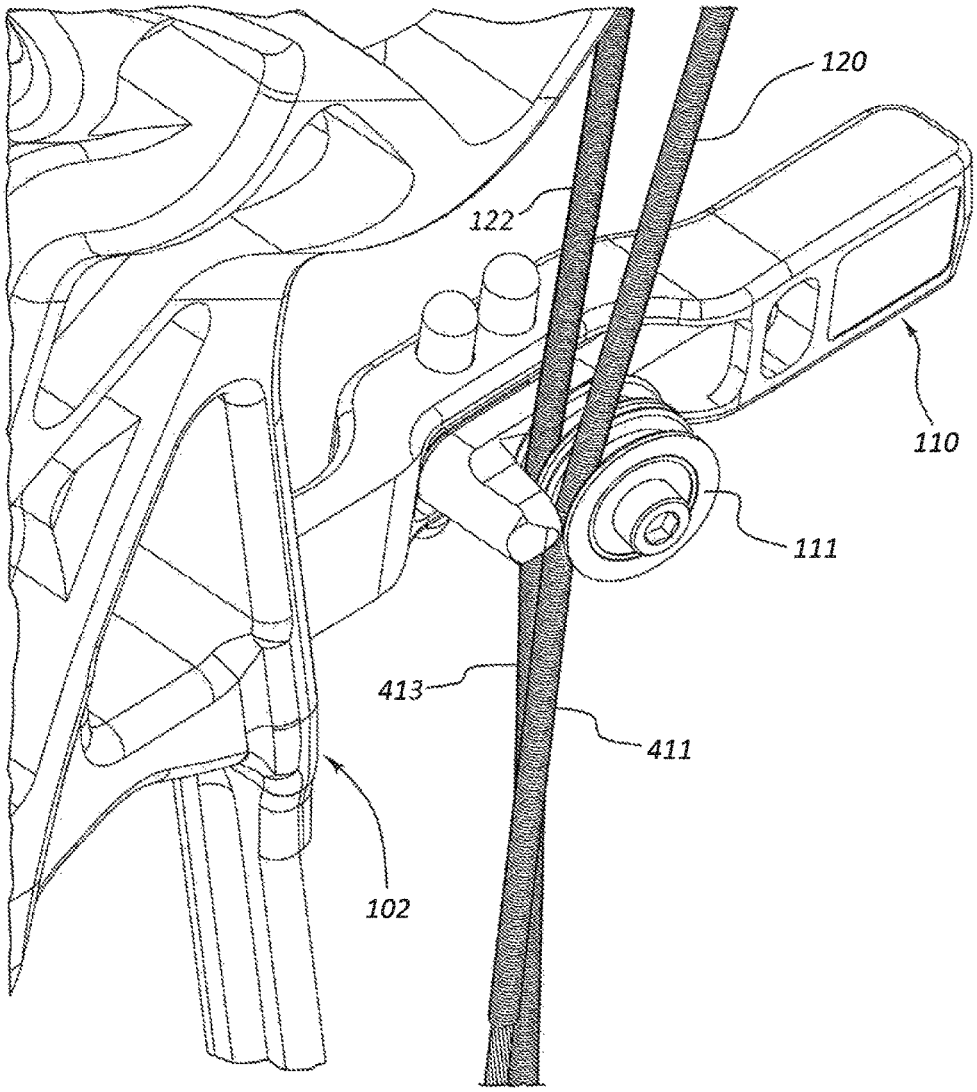
FIG. 14 is a view of a cable guard and cables of a bow according to an embodiment of the present disclosure.
Figure 15:
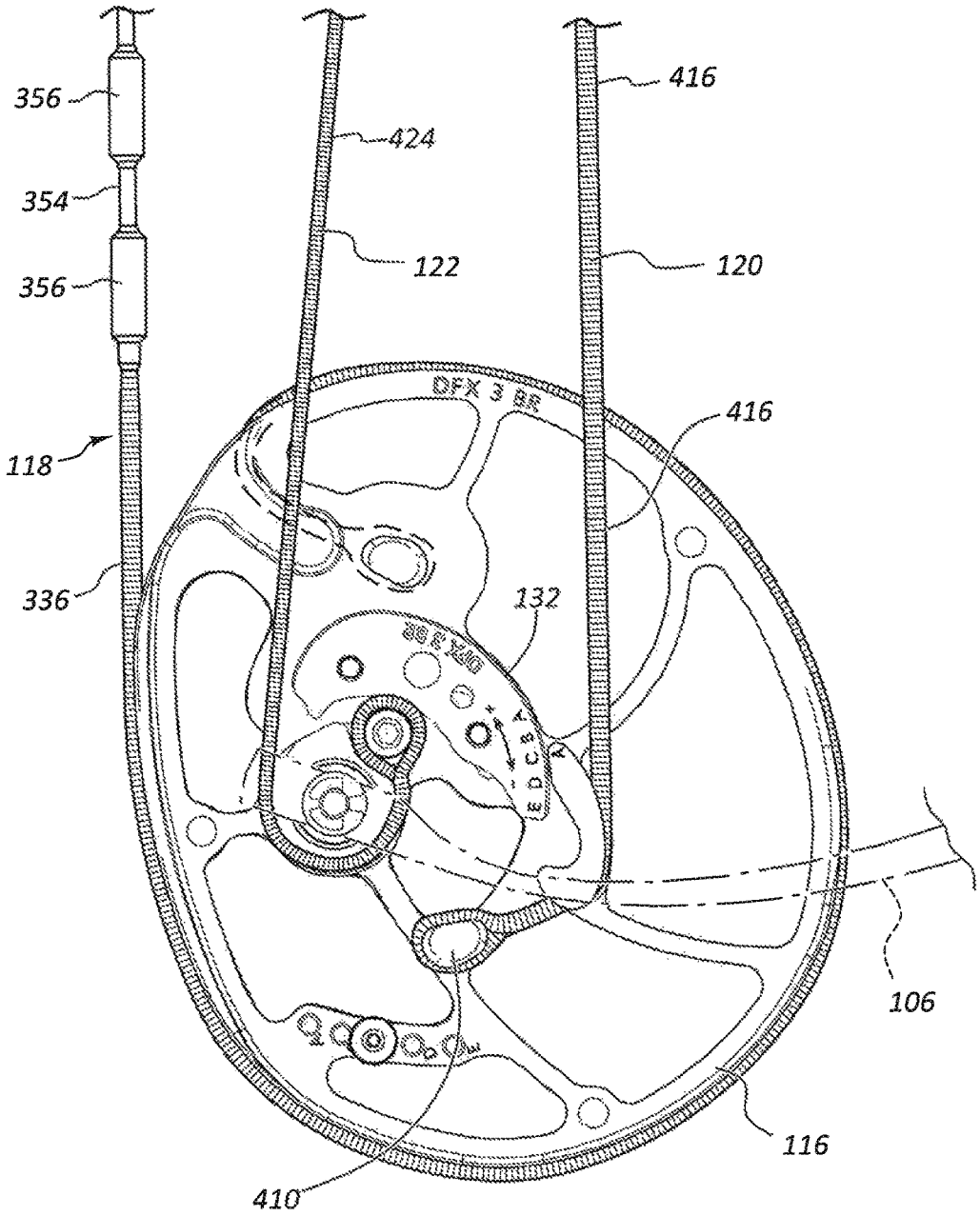
FIG. 15 is a side view of a lower cam, strings, and cables according to an embodiment of the present disclosure, with a side wall of the lower cam removed.

FIG. 12 shows the YBC 120 in a full draw position, and FIG. 13 shows the CBC 122 in a full draw position. FIGS. 12 and 13 show the cables 120, 122 isolated from the rest of the bow 100. FIG. 14 shows the cables 120, 122 where they contact the cable guard 110. FIGS. 15-18 show side views of the cams 114, 116 and the portions of the strings 118, 120, 122 adjacent to the cams 114, 116 with the cams 114, 116 and cables 120, 122 in a brace condition.

As shown in FIGS. 12 and 15-18, the YBC 120 may comprise a first end 400 and a second end 402. Each end 400, 402 may comprise an end loop 404, 406 configured to be positioned around a peg, bolt, hook, or other retaining portion 408, 410 on the upper and lower cams 114, 116. In some embodiments, the retaining portions 408, 410 may be referred to as yoke anchors. The YBC 120 may comprise two end loops 404, wherein the two end loops 404 fork apart from each other opposite to the other end loop 406. Thus, the entire YBC 120 may form a "Y" shape with each of the end loops 404 on each side of the upper cam 114, as shown by the two end loops 404 on each side of the upper cam 114 in FIGS. 17 and 18. The CBC 122 may comprise first and second end loops 407, 409 at its opposite ends 401, 403 as well.

As explained above, each of the cables 120, 122 may wind around respective cable winding support portions 130, 132 of the upper and lower cams 114, 116 when the bow is drawn. As the limbs 104, 106 flex inward and the cables 120, 122 wind around the cams 114, 116, the cables 120, 122 may slide along or may be in rolling contact with portions of the cable guard 110, which may comprise at least one roller 111 or other smooth support in contact with the cables 120, 122 where they contact the cable guard 110. See FIG. 14. The cables 120, 122 may therefore each comprise a serving material configured to contact the at least one roller 111 or other parts of the cable guard 110. This serving material may be referred to as a guard serving material 411, 413 or roller-contacting serving material. The guard serving material 411, 413 may cover portions of the cables 120, 122 that are configured to bend when the bow 100 is used. Therefore, they may be referred to as bending portions of the cables 120, 122.

The guard serving material 411, 413 on each of the cables 120, 122 may enhance the durability of the cables 120, 122 while they are rolled against the at least one roller 111 or slide against other portions of the cable guard 110. Therefore, the guard serving material 411, 413 may comprise a material that differs from the bundle of strands used in the cables 120, 122, such as a material that is more resilient against wear caused by sliding or rolling. The guard serving material 411, 413 may also be weighted, wherein the material in the guard serving material 411, 413 is denser or thicker than the material used in the bundles of strands of the cables 120, 122. Furthermore, the guard serving material 411, 413 may increase the overall diameter of the cables 120, 122 where they come into contact with the cable guard 110, thereby better distributing stresses across the cables 120, 122 that are caused by contact with the cable guard 110. Serving material used elsewhere on the bowstring 118 or cables 120, 122 may also be used to help distribute forces, particularly where the serving material is in contact with other parts of the bow (e.g., the cams 114, 116), the arrow (e.g., at the nocking point 124), or the archer.

As shown in FIGS. 2, 12, and 13, the YBC 120 may comprise a lower cam tangency point 412 and the CBC 122 may comprise an upper cam tangency point 414 when the bow 100 is at full draw. A lower YBC serving material 416 may cover the YBC 120 from the loop 406 to at least the lower cam tangency point 412, and an upper CBC serving material 418 may cover the CBC 122 from its upper loop 407 to its upper cam tangency point 414. The first end 400 of the YBC 120 may comprise an upper YBC serving material 420 extending along the length of the YBC 120 from the end loop 404 toward the opposite end 402, and the lower end 422 of the CBC 122 may comprise a lower CBC serving material 424 positioned on the CBC 122 starting at the end loop 409 and extending along the length of the CBC 122 toward the upper cam tangency point 414. In some embodiments, there may be upper YBC serving material 420 on each of the separate upper end parts of the "Y" configuration.

In some configurations, the upper YBC serving material 420 may extend to, and be part of, the guard serving material 411 on the YBC 120. Similarly, as shown in FIG. 13, the upper CBC serving material 418 may extend to or may be connected to the guard serving material 413 on the CBC 122. The guard serving material 411 on the YBC 120 may also be part of, and extend to, the lower YBC serving material 416. The guard serving material 413 on the CBC 122 may also be part of, and extend to, the lower CBC serving material 424.

Accordingly, the various serving materials 411, 413, 416, 418, 420, 424 on the YBC 120 and CBC 122 may each be configured to have lengths along the axes of the cables 120, 122, wherein the lengths can be varied or customized according to the needs of the user. The length of the serving material applied to the YBC 120 or CBC 122 may be controlled and customized to influence the weight of the YBC 120, CBC 122, or the bow 100 as a whole, especially in cases where the serving material on the cables 120, 122 is denser or greater in diameter than the longitudinal bundle of strands or fibers used in the rest of the cables 120, 122. Thus, that weight (or the weight centroid of the cables 120, 122) may be localized in certain parts of the cables 120, 122 and optimized for dampening vibration, thereby reducing the overall weight of the cables 120, 122, and improving efficiency of the bow 100.

Figure 19:
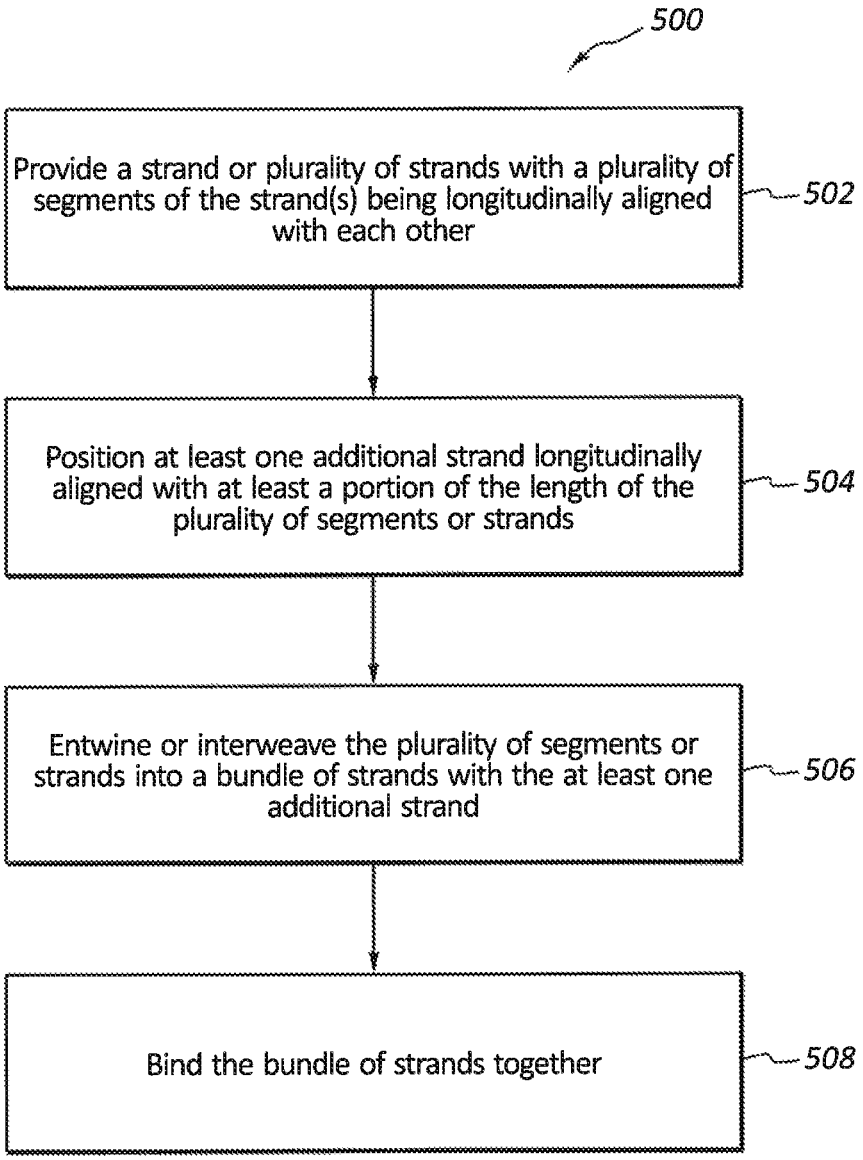
FIG. 19 shows a process flowchart according to an embodiment of the present disclosure.

FIG. 19 illustrates a process flowchart of a method 500 according to the present disclosure. The method 500 is a method for constructing or modifying a bowstring so that the bowstring comprises multiple materials. For example, the method 500 may include providing at a first strand, as indicated in block 502. The first strand may be a very long, continuous strand repeatedly wrapped or looped so that a plurality of segments of the first strand are longitudinally aligned with each other. In other words, the segments may be generally longitudinally-oriented portions of the first strand and may be positioned laterally next to each other. Alternatively, the method may include providing a plurality of separate strands that are longitudinally aligned with each other. The plurality of segments or separate strands may be arranged so that portions of the segments or strands are configured to be positioned at the ends of a bowstring and portions thereof are configured to be positioned along the intermediate length of the bowstring.

Along at least a portion of the length of the strands or segments, at least one additional strand of material may be positioned longitudinally aligned with the rest of the bundle of strands (e.g., as shown by additional strands 344, 346 in FIG. 8), as indicated in block 504. The additional strand or strands may comprise a different material composition from the bundle of strands of the first strand or plurality of strands.

The plurality of segments or strands may be entwined or interwoven with each other to form a bundle of strands (e.g., as shown by bundle of strands 340 in FIG. 7) with the at least one additional strand, as indicated in block 506. The bundle of strands may be bound together or covered by a serving material along portions of the length of the bowstring.

The bundle of strands, together with the additional strand or strands, may be bonded to each other or coupled to each other with the bundle of strands being longitudinally aligned with the additional strand or strands such that all of the strands are bound or coupled to each other, as indicated in block 508. In some embodiments, the strands may be bonded or coupled to each other using a serving material that is tightly wrapped around all of the strands such that the strands are all tightly bound together by the serving material. In some embodiments, the strands may be coated with a material (e.g., a matrix material 348, as shown in FIG. 9) that binds or couples them to each other. The additional strand may increase the thickness, rigidity, or other properties of the bundle of strands, as described elsewhere herein. Thus, certain portions of the length of the bowstring may comprise different mechanical properties.

In some arrangements, the additional strand or strands may be positioned along portions of the string that are configured to be subjected to high stress concentrations relative to other portions of the string. The additional strand or strands may also be applied along portions of the string that are configured to remain substantially straight when the string is used, particularly if the addition of the additional strands causes the string to become more rigid in the portions of the string where the additional strands are positioned. In some configurations, the additional strands are served in a manner wherein portions of the length of the additional strands are free-ended and allowed to spread away from the bundle of strands, or the additional strands are served in a manner allowing portions of their length to have low tension or form arches relative to the rest of the bundle of strands. Thus, many features and objectives of the embodiments disclosed elsewhere herein may be obtained using the method 500.

Various inventions have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including:" and "having" come as used in the specification and claims shall have the same meaning as the term "comprising."

What is claimed is:

1. A composite archery string, comprising:

a plurality of generally longitudinal strands comprising at least a first strand and a second strand, the first strand having a first length, the second strand having a second length, the first length being different from the second length;

wherein upon application of a first tensile load to the plurality of generally longitudinal strands, the first strand bears a first proportion of first tensile load relative to the second strand;

wherein upon application of a second tensile load to the plurality of generally longitudinal strands, the first strand bears a second proportion of the second tensile load relative to the second strand, the second proportion being less than the first proportion, the second tensile load being greater than the first tensile load.

2. The composite archery string of claim 1, wherein the first strand bears the entire first tensile load upon application of the first tensile load, and the first strand bears less than the entire second tensile load upon application of the second tensile load.

3. The composite archery string of claim 1, wherein at least one of the first and second strands is configured to extend upon application of the second tensile load at least until the first and second strands have equal lengths.

4. The composite archery string of claim 1, wherein the first length of the first strand comprises a bow-contacting portion and a bending portion, and wherein the second length of the second strand is positioned between the bow-contacting portion and the bending portion.

5. The composite archery string of claim 1, wherein the first and second lengths overlap on the string, and wherein the first strand is more rigid where the first length overlaps the second length of the second strand than along a remaining length of the first strand.

6. The composite archery string of claim 1, wherein the first strand comprises a first material and the second strand comprises a second material, the first material being different than the second material.

7. The composite archery string of claim 6, wherein the first material has a material property different from the second material, the material property being at least one of density, elasticity, bending resistance, abrasion resistance, tensile strength, and toughness.

8. The composite archery string of claim 1, further comprising a helically winding material positioned around the plurality of generally longitudinal strands, wherein the second strand extends through the helically winding material.

9. The composite archery string of claim 1, wherein the second strand is configured to extend through a portion of the string contacting a portion of a bow that is rotatable relative to a limb or cable guard of the bow.

10. The composite archery string of claim 1, wherein the second strand extends through a portion of the string configured to be nocked with an arrow when the string is attached to a bow and the bow is drawn.

11. The composite archery string of claim 1, further comprising at least one strand positioned radially spaced apart from the plurality of generally longitudinal strands, wherein tension in the at least one strand is configured to be less than tension in the plurality of generally longitudinal strands.

12. The composite archery string of claim 1, further comprising a matrix material positioned external to the plurality of generally longitudinal strands.

13. The composite archery string of claim 1, wherein the first strand comprises a first plurality of strands and the second strand comprises a second plurality of strands, wherein the first plurality of strands has a different radial position in the plurality of generally longitudinal strands relative to the second plurality of strands.

14. A composite archery string, comprising:

a plurality of entwined strands comprising a first portion of strands, a second portion of strands, and a generally longitudinal axis, the first portion of strands and second portion of strands each extending substantially parallel to the generally longitudinal axis, the first and second portions of strands each having an equal helical twist rate per unit length along the longitudinal axis, the first portion of strands comprising a first length and a first material, the second portion of strands comprising a second length and a second material, the first length being different from the second length, the first material being different from the second material.

15. The composite archery string of claim 14, wherein the first portion of strands and the second portion of strands are each configured to have a substantially equal length upon application of a tensile load to the plurality of entwined strands.

16. The composite archery string of claim 14, wherein the first material differs from the second material due to material properties comprising at least one of bending resistance, toughness, abrasion resistance, density, and tensile elasticity.

17. The composite archery string of claim 14, wherein the composite archery string comprises a first length portion and a second length portion, the first length portion having greater resistance to bending than the second length portion.

18. The composite archery string of claim 14, further comprising a serving material positioned radially external to the plurality of entwined strands, the serving material comprising a third material, the third material being different from the first and second materials.

19. The composite archery string of claim 14, wherein additional strands comprising the first or second material are positioned on the plurality of entwined strands at positions configured to bear higher concentrations of stress relative to other positions on the string where the additional strands are not positioned.

20. The composite archery string of claim 14, wherein the second portion of strands are spaced radially away from the first portion of strands.

21. An archery bow, comprising:

a riser;

an upper limb and a lower limb, the upper and lower limbs being connected to the riser;

an upper string contacting portion and a lower string contacting portion, the upper string contacting portion being positioned on the upper limb, the lower string contacting portion being positioned on the lower limb;

a string extending from the upper limb to the lower limb, the string comprising a composite material having a first portion contacting the upper string contacting portion, a second portion contacting the lower string contacting portion, and a third portion extending between the first portion and the second portion;

wherein the first portion of the composite material comprises a first density, the third portion of the composite material comprises a second density, and the first density is greater than the second density.

22. The archery bow of claim 21, wherein the upper string contacting portion comprises a groove, the first portion contacting the upper string contacting portion within the groove.

23. The archery bow of claim 21, wherein the second portion of the composite material comprises the first density.

24. The archery bow of claim 21, wherein the first portion of the composite material comprises a serving material extending along a length of the first portion, the first portion comprises at least one longitudinal strand extending along the length, and the serving material is denser than the at least one longitudinal strand.

25. The archery bow of claim 21, wherein the string is a bowstring.

26. The archery bow of claim 21, wherein the string is a buss cable.

27. The archery bow of claim 21, wherein the composite material comprises a fourth portion configured to engage a cable guard or string dampener of the bow, wherein the fourth portion comprises a third density that is greater than the second density.

28. The archery bow of claim 21, wherein the first and second portions of the composite material are more flexible than the third portion.

29. The archery bow of claim 21, wherein the first portion of the composite material comprises a first length, the third portion of the composite material comprises a second length, and a third length extends across the first and second lengths, and wherein a first longitudinal strand extends across the third length and a second longitudinal strand extend across only the first length or the second length.

30. The archery bow of claim 21, wherein the first and second string contacting portions are cams.

31. The archery bow of claim 21, wherein the first and second string contacting portions are limbs.

32. A composite archery string, comprising:

a plurality of generally longitudinal strands, the plurality of generally longitudinal strands having a first density;

a helically winding material positioned around the plurality of generally longitudinal strands, the helically winding material having a second density, the second density being greater than the first density.

* * * * *